US011234878B2

(12) United States Patent
Montgomery et al.

(10) Patent No.: US 11,234,878 B2
(45) Date of Patent: Feb. 1, 2022

(54) HIGH PERFORMANCE, SKIN FRIENDLY, FABRIC FOR PATIENT TRANSFER AND CARE AND LIFTING DEVICES MADE THEREFROM

(71) Applicant: Precision Fabrics Group, Inc., Greensboro, NC (US)

(72) Inventors: Terry G. Montgomery, Greensboro, NC (US); James H. Barry, Greensboro, NC (US); Kavita Mathur, Cary, NC (US)

(73) Assignee: Precision Fabrics Group, Inc., Greensboro, NC (US)

( * ) Notice: Subject to any disclaimer, the term of this patent is extended or adjusted under 35 U.S.C. 154(b) by 643 days.

(21) Appl. No.: 16/062,868

(22) PCT Filed: Dec. 14, 2016

(86) PCT No.: PCT/US2016/066516
§ 371 (c)(1),
(2) Date: Jun. 15, 2018

(87) PCT Pub. No.: WO2017/106261
PCT Pub. Date: Jun. 22, 2017

(65) Prior Publication Data

US 2019/0060147 A1 Feb. 28, 2019

Related U.S. Application Data

(60) Provisional application No. 62/371,990, filed on Aug. 8, 2016, provisional application No. 62/268,195, filed on Dec. 16, 2015.

(51) Int. Cl.
*A61G 7/10* (2006.01)
*A47G 9/02* (2006.01)
(Continued)

(52) U.S. Cl.
CPC ..... *A61G 7/1023* (2013.01); *A47G 9/007* (2013.01); *A47G 9/02* (2013.01); *A47G 9/0238* (2013.01);
(Continued)

(58) Field of Classification Search
None
See application file for complete search history.

(56) References Cited

U.S. PATENT DOCUMENTS 2,590,995 A 4/1952 Merrill
2,665,432 A 1/1954 Butler
(Continued)

FOREIGN PATENT DOCUMENTS

FR 2950083 3/2011
WO 2007073488 6/2007

OTHER PUBLICATIONS

International Search Report and the Written Opinion of the International Searching Authority corresponding to International Patent Application No. PCT/US2016/066516 (11 pages) (dated Mar. 9, 2017).

(Continued)

*Primary Examiner* — Shawn Mckinnon
(74) *Attorney, Agent, or Firm* — Myers Bigel, P.A.

(57) ABSTRACT

Provided are fabrics and lifting devices that are high performance and skin friendly, for patient care, including as bed linens upon which a patient may sleep and/or rest, as well as patient slings for lifting and/or repositioning a patient.

26 Claims, 11 Drawing Sheets

(51) Int. Cl.

| | |
|---|---|
| ***A47G 9/00*** | (2006.01) |
| ***D03D 1/00*** | (2006.01) |
| ***A61G 7/057*** | (2006.01) |
| ***D03D 15/00*** | (2021.01) |

(52) U.S. Cl.

CPC ..... *A61G 7/057* (2013.01); *A61G 7/1026* (2013.01); *D03D 1/0017* (2013.01); *D03D 15/00* (2013.01); *A61G 2205/00* (2013.01); *D10B 2331/02* (2013.01); *D10B 2331/04* (2013.01); *D10B 2503/06* (2013.01)

(56) References Cited

U.S. PATENT DOCUMENTS

| | | | | |
|---|---|---|---|---|
| 3,009,489 | A | 11/1961 | McCrary | |
| 3,699,958 | A | 10/1972 | Szucs | |
| 3,829,914 | A | 8/1974 | Treat | |
| 4,067,852 | A | 1/1978 | Calundann | |
| 4,368,234 | A | 1/1983 | Palmer et al. | |
| 4,479,993 | A | 10/1984 | James | |
| 4,675,925 | A | 6/1987 | Littleton | |
| 4,700,417 | A | 10/1987 | McGovern | |
| 4,742,588 | A | 5/1988 | James | |
| 4,919,998 | A | 4/1990 | Goad et al. | |
| 4,944,053 | A | 7/1990 | Smith | |
| 5,026,398 | A | 6/1991 | May et al. | |
| 5,079,044 | A | 1/1992 | Schumacher et al. | |
| 5,234,764 | A | 8/1993 | Nelson et al. | |
| 5,304,414 | A | 4/1994 | Bainbridge et al. | |
| 5,329,655 | A | 7/1994 | Garner | |
| 5,442,821 | A | 8/1995 | Weeks | |
| 5,700,742 | A | 12/1997 | Payne | |
| 5,972,484 | A | 10/1999 | Cohen et al. | |
| 6,024,823 | A | 2/2000 | Rubin et al. | |
| 6,341,393 | B1 | 1/2002 | Votel | |
| 6,627,562 | B1 | 9/2003 | Gehring, Jr. | |
| 7,045,673 | B1 | 5/2006 | Batich et al. | |
| 7,218,231 | B2 | 5/2007 | Higham | |
| 7,390,774 | B2 | 6/2008 | Ghosh et al. | |
| 7,428,772 | B2 | 9/2008 | Rock | |
| 7,709,694 | B2 | 5/2010 | Batich et al. | |
| 7,725,967 | B2 * | 6/2010 | Simmerer | A61G 1/01 5/601 |
| 7,790,217 | B2 | 9/2010 | Toreki et al. | |
| 7,816,288 | B2 | 10/2010 | Leonard et al. | |
| 7,886,514 | B2 | 2/2011 | Hegan, Jr. | |
| 7,990,272 | B2 * | 8/2011 | Wass | G06Q 50/28 340/572.1 |
| 8,114,063 | B2 | 2/2012 | Sacco et al. | |
| 8,183,167 | B1 | 5/2012 | Delattre et al. | |
| 8,186,390 | B2 | 5/2012 | Krishnaswamy et al. | |
| 8,230,537 | B2 | 7/2012 | Stewart et al. | |
| 8,283,267 | B2 | 10/2012 | Leonard et al. | |
| 8,346,632 | B2 | 1/2013 | Saghbini | |
| 8,491,922 | B2 | 7/2013 | Eddy | |
| 8,808,602 | B2 | 8/2014 | Andrewartha et al. | |
| 8,858,926 | B2 | 10/2014 | Dong et al. | |
| 8,900,624 | B2 | 12/2014 | Karandikar et al. | |
| 8,962,027 | B2 | 2/2015 | Kennedy | |
| 2004/0200225 | A1 * | 10/2004 | Mittricker | F22B 1/1815 60/783 |
| 2011/0190795 | A1 | 8/2011 | Hotter et al. | |
| 2012/0021218 | A1 | 1/2012 | Lee et al. | |
| 2012/0061980 | A1 | 3/2012 | Mamie et al. | |
| 2013/0086748 | A1 | 4/2013 | Walter et al. | |
| 2013/0183495 | A1 * | 7/2013 | Rock | D06M 13/192 428/156 |
| 2014/0090167 | A1 | 4/2014 | Hillenbrand | |
| 2015/0074903 | A1 * | 3/2015 | Berg | A61G 7/1013 5/83.1 |

OTHER PUBLICATIONS

Enos, L. "Safe Patient Handling and Patient Safety: Identifying the Current Evidence Base and Gaps in Research" American Journal of Safe Patient Handling & Movement 3(3): 94-102 (2013) (Abstract only).

Dow Chemical Company "SILVADUR™ 900 Antimicrobial" Product Information http://msdssearch.dow.com/PublishedLiteratureDOWCOM/dh_08d2/0901b803808d22ac.pdf?filepath=microbial/pdfs/noreg/253-03013.pdf&fromPage=GetDoc (4 pages) (believed to be as early as Dec. 2015).

Handicare "SafeHandlingSheet: SystemRoMedic" Product manual (4 pages) (believed to be as early as Dec. 2015).

Handicare "SystemRoMedic Lifting Slings" Product catalog (48 pages) (believed to be as early as Dec. 2015).

Hill-Rom "FlexoStretch™ Lift Stretcher" Product description https://www.hill-rom.com/usa/Products/Category/Patient-Handling/Horizontal-Lifts/FlexoStretch/ (1 page) (believed to be as early as Dec. 2015).

Hill-Rom "OctoStretch™ Lift Stretcher" Product description https://www.hill-rom.com/usa/Products/Category/Patient-Handling/Horizontal-Lifts/OctoStretch/ (1 page) (believed to be as early as Dec. 2015).

Hill-Rom "RepoSheet® Lift Aid" Product description https://www.hill-rom.com/usa/Products/Category/Patient-Handling/Slings-Lift-sheets/RepoSheet/ (1 page) (believed to be as early as Dec. 2015).

Hill-Rom "Solo RepoSheet® Lift Aid" Product description https://www.hill-rom.com/usa/Products/Category/Patient-Handling/Slings-Lift-sheets/Solo-RepoSheet/ (1 page) (believed to be as early as Dec. 2015).

International Preliminary Report on Patentability corresponding to International Patent Application No. PCT/US2016/066516 (8 pages) (dated Jun. 28, 2018).

Phillips et al. "A Novel lifting sheet has minimal impact on the off-loading performance of an 'active' (alternating) pressure-redistributing (PR) mattress?" European Pressure Ulcer Advisory Panel (EPUAP) Conference Poster (1 page) (2013).

Shahidi et al. "Antibacterial Agents in Textile Industry" Antimicrobial Agents, Chapter 19:387-406 (2012).

* cited by examiner

HIGH PERFORMANCE, SKIN FRIENDLY, FABRIC FOR PATIENT TRANSFER AND CARE AND LIFTING DEVICES MADE THEREFROM

RELATED APPLICATION INFORMATION

This application claims the benefit of and priority to U.S. Provisional Patent Application Ser. No. 62/268,195, filed Dec. 16, 2015, and U.S. Provisional Patent Application Ser. No. 62/371,990, filed Aug. 8, 2016, the disclosure of each of which are incorporated herein by reference in their entirety.

FIELD OF THE INVENTION

The present invention relates to both fabric and lifting devices made therefrom that are high performance and skin friendly, for patient care, including as bed linens upon which a patient may sleep and/or rest, as well as patient slings for lifting and/or repositioning a patient.

BACKGROUND OF THE INVENTION

In hospitals, nursing homes, and home-care settings, a range of devices are used by caregivers to lift and reposition patients. These devices are typically made from conventional high-strength textile materials commonly found in the freight-handling industry and adapted for healthcare use. A repositioning sheet may be used to transversely move a patient over a bed's support surface; a lifting sling, connected to an overhead lifting system, may be used when a person is being lifted out of bed or lifted from the floor; and a transfer sheet may be used to transfer a patient from one bed to another support surface.

Because of the inappropriate materials used in their construction, these healthcare lifting/repositioning devices are often the root cause of adverse effects on skin health associated with skin abrasions and tears, bed sores, skin hygiene, surface contamination, and bacteria growth. These incumbent devices are difficult to clean and launder after use for patients. These devices are also difficult to place under patients and to easily remove from underneath patients when cleaning is needed.

Healthcare workers are also at risk of injury when these devices are not ergonomically compatible with their ability to safely move or reposition patients. A leading cause of injury to health care workers is musculoskeletal disorders such as strains and sprains. In 2012, healthcare providers suffered more musculoskeletal injuries than construction, mining, and manufacturing workers (OSHA 2013).

The current state of patient lifting/repositioning technologies typically involves the use of textile materials which are heavy, stiff, and densely woven to achieve high tensile and tear strengths, and fabricated into lifting/repositioning devices with abrasive and uneven surfaces. Their structure and surfaces are typically not designed to be skin-friendly; that is, to effectively manage the skin's moisture, friction and shear—all important factors for patients' skin health. Fabrics used in lifting/repositioning devices typically have high friction with the skin and generate large concentrations of soil particles, broken fibers, and lint, leading to bacteria accumulation and cross-contamination in healthcare settings. Such properties also produce an uncomfortable support surface for patients, and may cause skin breakdown after extended exposure by not properly managing air and moisture vapor transport, eventually leading to skin breakdown and infection. Incumbent devices using these fabrics often incorporate webbing sewn at intervals across the undercarriage of the lifting/repositioning devices to ensure that these fabrics, and the devices, can safely support large or bariatric patients. Braided webbings sewn to support these lifting/repositioning devices create ridges and irregular support surfaces, which can lead to skin abrasion and excoriation.

Due to their heavy and bulky construction, laundering of these lifting/repositioning devices is generally inefficient and ineffective—particularly over extended laundering cycles. In healthcare laundries, these devices are typically laundered separately in mesh bags to avoid entanglement with other products. As a result, lifting/repositioning devices, confined to mesh laundry bags, do not achieve adequate agitation, exposure to laundry chemicals for proper cleaning, rinsing or disinfection, and therefore often remain stained and contaminated after the laundering process.

Legislation in many states mandates the use of these lifting/repositioning devices, called Safe Patient Handling and Mobility (SPHM) devices. However, the impact of SPHM lift slings and repositioning devices on the efficacy of healthcare mattresses when left in place under patients is unclear. The success of these SPHM devices depends upon the ease and accessibility of equipment, and specifically whether lift slings may be left under patients in bed, ready for immediate use (Enos L. *Safe Patient Handling and Patient Safely: Identifying the Current Evidence Base and Gaps in Research*. Am J SPHM 3(3): 94-102 (2013)).

Healthcare professionals must make a judgment, based on unclear clinical evidence, as to whether SPHM devices may be left beneath patients between uses. Does this practice have an impact on the performance of the support surface? What impact does leaving a SPHM device under patients have on the clinical care and pressure ulcer development for patients? The 2014 International Pressure Ulcer Guidelines for repositioning patients recommends that healthcare professionals "Use manual handling aids to reduce friction and shear. Lift—don't drag—the individual while repositioning." Healthcare workers are urged to immediately remove repositioning slings after transfer and "Do not leave moving and handling equipment under the individual after use, unless the equipment is specifically designed for this purpose." (National Pressure Ulcer Advisory Panel, European Pressure Ulcer Advisory Panel (EPUAP) and Pan Pacific Pressure Injury Alliance (PPPIA). *Prevention and Treatment of Pressure Ulcers: Clinical Practice Guideline*. Emily Haesler (Ed.). Cambridge Media: Osborne Park, Western Australia; 2014).

Many healthcare facilities have encountered challenges with sustaining these SPHM programs due to the difficulty of managing lift slings and associated equipment. The concern is that these devices are an extra layer between the patient and the support surface. Does this extra layer have an adverse effect on the therapeutic properties of the support surface and how does that impact patient outcomes?

The fabric or composition of the lifting/repositioning device is therefore critically important. At the present time, customized textile materials have not been properly constructed and made available to overcome the challenges placed on SPHM devices and assist caregivers who must use them, as well as patients whose health and wellbeing are dependent upon them.

SUMMARY OF THE INVENTION

Features involved in embodiments of the fabrics described herein may enable a SPHM device to maintain a relatively light-weight, smooth, non-linting, skin-friendly support surface for patients which effectively manages the moisture, friction and shear important to skin health—efficiently functioning as a healthcare bed sheet, obviating the need for extra layers of support under bed-bound patients. Webbings sewn to the underside of lifting/repositioning devices to support patients' weight are not required. In some embodiments, use of antimicrobial materials on all fiber surfaces of the device reduces the growth of bacteria on these new lifting/repositioning devices.

The fabric is, in some embodiments designed to be incorporated as an integral component of lifting/repositioning devices and thereby improve these devices such that, in at least some embodiments, it may:

- Offer enhanced ergonomic design and fabric-structural performance; that is, the fabric provides a smoother surface for lifting/repositioning devices to minimize skin abrasion; is low linting, with minimal particle generation in use, thereby removing a potential source of cross-contamination; is stronger to support a wider range of patient weights and sizes, thereby reducing the time needed by caretakers to locate a device specific to patients' weight and size; and is lighter in weight, thereby improving the ease of transport and use by caretakers;
- Obviate the need for webbings sewn at intervals across the undercarriage of incumbent devices to fully support patients; that is, the fabric removes the need for undercarriage support webbings which often lead to skin abrasions and excoriation as a result of pulling patients over uneven support surfaces;
- Are more efficiently laundered; that is, devices using this fabric may be cleaned using conventional laundering processes for standard healthcare bedding, without the need for mesh-bags or special laundering equipment; and/or
- Have improved hygiene through the incorporation of antimicrobial properties.

L. Phillips and M. Clark, *A Novel lifting sheet has minimal impact on the off-loading performance of an 'active' (alternating) pressure-redistributing (PR) mattress*? EPUAP Conference Poster (2013), describes a 99 percent polyester microfiber lifting sheet on an active mattress, and finds that it has no detrimental effect on the pressure off-loading performance of a pressure-redistributing mattress as compared to a standard cotton sheet. However, the incorporation of high strength fibers to increase the lifting capacity of the sheet is neither suggested nor described, and the potential effect of incorporating such high-strength fibers on patient comfort and skin integrity is not addressed. See also MAXI TRANSFER SHEET Product Brochure (ArjoHuntleigh, Getinge Group, April 2014).

A comparison of fabric performance properties between the ArjoHuntleigh MAXI TRANSFER SHEET lifting/positioning device (Column A) and a fabric of the present invention with Dyneema® fibers as the first yarn (Column B) is shown in Table 1 below. Performance improvements are provided in Column C.

TABLE 1

Performance properties of a traditional lifting/repositioning device compared with a lifting/repositioning device fabricated according to an embodiment of the invention.

| Properties | A MAXI TRANSFER SHEET | B New Lifting Sheet With Dyneema ® | C % Improvement with New Lifting Sheet | D Test Method |
|---|---|---|---|---|
| Fiber Blend | | | | |
| Base Fabric | 100% Polyester | 96% Polyester/4% Dyneema ® | n/a | ASTM-D-629 |
| Weight (ounces per sq. yard) | | | | |
| Base Fabric | 4.7 | 3.3 | −30% | ASTM-D-3776 |
| Tensile Strength (lbs./inch) | | | | |
| Base Fabric | 199 | 264 | +33% | ASTM-D-5034 |
| Webbing* or Dyneema** | 240 | 445** | +85% | ASTM-D-5034 |
| Tear Strength (lbs./inch) | | | | |
| Base Fabric | 9 | 34 | +5% | ASTM-D-2261 |
| Webbing* or Dyneema** | 40 | 42** | n/a | ASTM-D-2261 |
| Particle Count (Particles/ft$^3$-min) | | | | |
| Base Fabric | 9,284 | 1,323 | −85.7% | INDA IST 160.1 |
| Drying Time (% Dryness @ 45 min) | | | | |
| Base Fabric | 52% | 100% | +100% | see below[1] |
| Antimicrobial Properties | | | | |
| Base Fabric | No | Yes | 100% Anti-microbial | AATCC 100 |
| Webbing* or Dyneema** | No* | Yes** | 100% Anti-microbial | AATCC 100 |

[1]A determination of % moisture loss of a fabric until dryness, measured in 15-minute intervals up to 60 minutes, whichever comes first. An 8" × 10" fabric sample was tested at intervals. The rate was calculated based upon the time it takes for the sample to return to its original dry weight.

In some embodiments of the present invention, we have found that incorporation of high strength fibers such as VECTRAN® or DYNEEMA® high strength fibers into the lifting sheet, to increase the lifting capacity of the sheet for heavier patients, appears to have no detrimental effect on patient comfort or patient skin integrity (e.g., the formation of pressure sores). In three separate hospital trials, an embodiment of this device using VECTRAN® high strength fibers was used to lift and reposition intensive-care patients at risk for development of pressure ulcers. In each case, no pressure ulcers were reported, while at the same time, the device was successfully laundered and cleaned using conventional hospital laundering equipment and processes. This is surprising in that such high strength fibers are generally less yielding than lower strength fibers, and consequently were expected to be more abrasive to the patient's skin. Conventional healthcare laundering procedures for bed sheets are also not suitable to satisfactorily launder and clean lifting/positioning devices.

The present invention is explained in greater detail in the drawings herein and the specification set forth below. The disclosures of all United States patent references cited herein are to be incorporated by reference herein in their entirety.

DETAILED DESCRIPTION OF ILLUSTRATIVE EMBODIMENTS

Figure 1A:
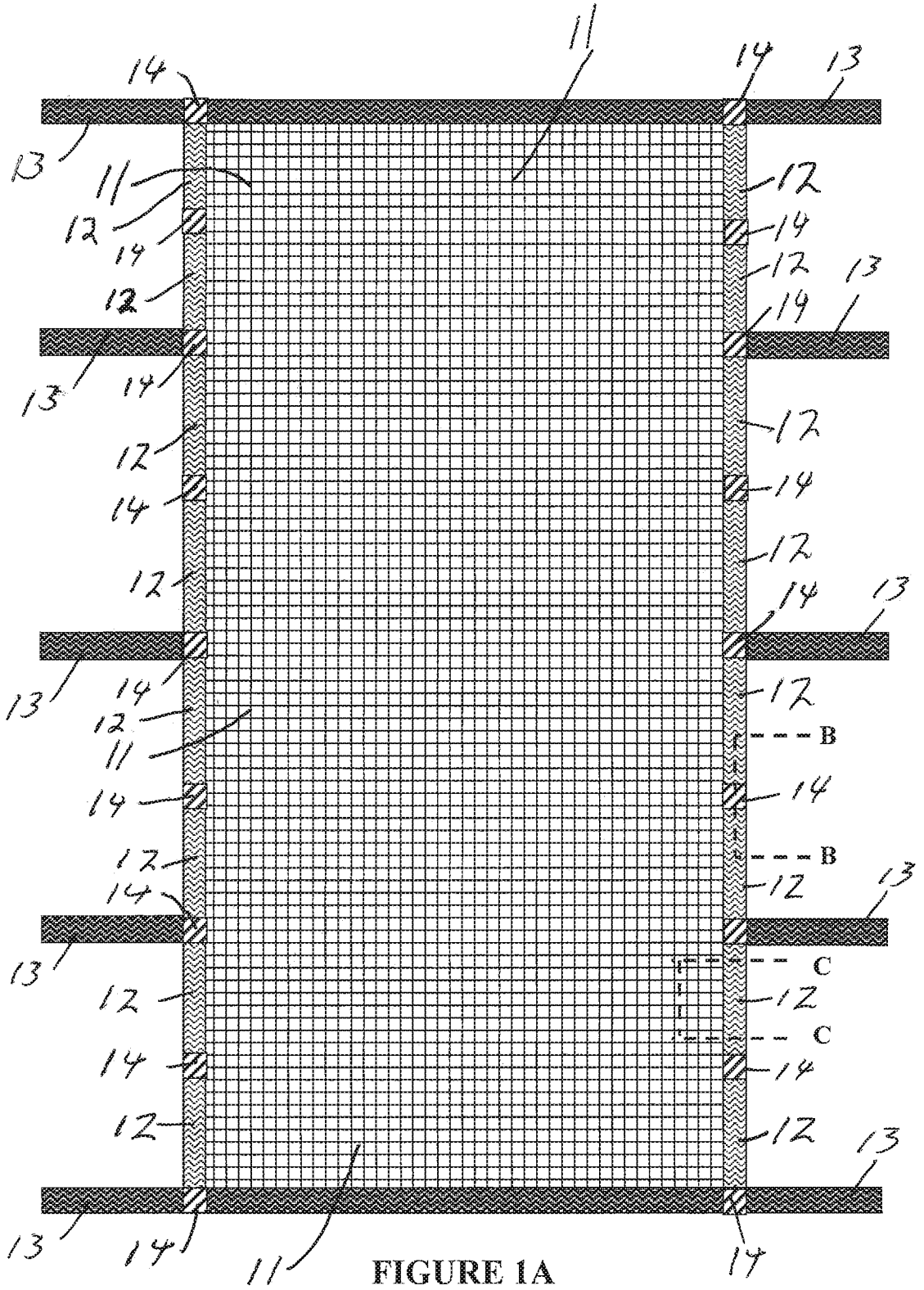
FIG. 1A. A first illustrative embodiment of a lifting and repositioning sheet using one embodiment of a fabric of the present invention.

The present invention is now described more fully hereinafter with reference to the accompanying drawings, in which embodiments of the invention are shown. This invention may, however, be embodied in many different forms and should not be construed as limited to the embodiments set forth herein; rather these embodiments are provided so that this disclosure will be thorough and complete and will fully convey the scope of the invention to those skilled in the art.

Like numbers refer to like elements throughout. In the figures, the thickness of certain lines, layers, components, elements or features may be exaggerated for clarity. Where used, broken lines illustrate optional features or operations unless specified otherwise.

The terminology used herein is for the purpose of describing particular embodiments only and is not intended to be limiting of the invention. As used herein, the singular forms "a," "an" and "the" are intended to include plural forms as well, unless the context clearly indicates otherwise. It will be further understood that the terms "comprises" or "comprising," when used in this specification, specify the presence of stated features, integers, steps, operations, elements components and/or groups or combinations thereof, but do not preclude the presence or addition of one or more other features, integers, steps, operations, elements, components and/or groups or combinations thereof.

As used herein, the term "and/or" includes any and all possible combinations or one or more of the associated listed items, as well as the lack of combinations when interpreted in the alternative ("or").

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and claims and should not be interpreted in an idealized or overly formal sense unless expressly so defined herein. Well-known functions or constructions may not be described in detail for brevity and/or clarity.

It will be understood that when an element is referred to as being "on," "attached" to, "connected" to, "coupled" with, "contacting," etc., another element, it can be directly on, attached to, connected to, coupled with and/or contacting the other element or intervening elements can also be present. In contrast, when an element is referred to as being, for example, "directly on," "directly attached" to, "directly connected" to, "directly coupled" with or "directly contacting" another element, there are no intervening elements present. It will also be appreciated by those of skill in the art that references to a structure or feature that is disposed "adjacent" another feature can have portions that overlap or underlie the adjacent feature.

Spatially relative terms, such as "under," "below," "lower," "over," "upper" and the like, may be used herein for ease of description to describe an element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus the exemplary term "under" can encompass both an orientation of over and under. The device may otherwise be oriented (rotated 90 degrees or at other orientations) and the spatially relative descriptors used herein interpreted accordingly. Similarly, the terms "upwardly," "downwardly," "vertical," "horizontal" and the like are used herein for the purpose of explanation only, unless specifically indicated otherwise.

It will be understood that, although the terms first, second, etc., may be used herein to describe various elements, components, regions, layers and/or sections, these elements, components, regions, layers and/or sections should not be limited by these terms. Rather, these terms are only used to distinguish one element, component, region, layer and/or section, from another element, component, region, layer and/or section. Thus, a first element, component, region, layer or section discussed herein could be termed a second element, component, region, layer or section without departing from the teachings of the present invention. The sequence of operations (or steps) is not limited to the order presented in the claims or figures unless specifically indicated otherwise.

As noted above, the present invention provides a bed sheet useful as both a bed mattress cover upon which a person may rest and/or sleep, and as a sling by which an immobile person may be lifted from and/or repositioned on a bed mattress upon which that person lies.

In some embodiments, the bed sheet is woven entirely from a first, higher breaking strength yarn. In other embodiments, the bed sheet is woven from a first yarn and a second yarn, the first yarn having a higher breaking strength than the second yarn (which second yarn may be referred to as a lower breaking strength yarn).

In some embodiments, the woven fabric has an upper and/or lower surface (e.g., both an upper and lower surface, such that the sheet is reversible) that are the same, both suitable for contacting the person, the upper and/or lower surface having a coefficient of friction not more than 0.4, 0.35, or 0.3.

In some embodiments, the woven fabric, after being saturated with water, dries to at least 90 percent dryness within 45 minutes at room temperature (e.g., 70° F. or 21° C.) and 70% relative humidity.

In some embodiments, the woven fabric has a tensile strength in pounds per inch of at least 160, 200, or 220 pounds per inch.

In some embodiments, the woven fabric has a tear strength of at least 30, 35, or 40 pounds per inch.

In some embodiments, the bed sheet is woven from: (i) the second yarn in one of the warp or fill (preferably warp) directions, and (ii) the first yarn, alone or in combination with the second yarn, in the other of the warp or fill (preferably fill, or cross-machine) directions.

In some embodiments, the bed sheet typically includes:

a continuous length of woven fabric having a top edge portion, a bottom edge portion, a left side edge portion, and a right side edge portion, the bed sheet having a plurality of wide segments and a plurality of narrow segments integrally woven with one another and arranged parallel to and in a repeating alternating pattern with one another;

each of the wide segments and the narrow segments extending from the left side edge portion to the right side edge portion;

the narrow segments woven from at least a second yarn (e.g. a continuous filament yarn) and a first yarn (e.g. a continuous filament yarn), the first yarn having a higher breaking strength than the second yarn; and the wide segments woven from at least the second yarn, and preferably not woven from the first yarn.

In general, the fabric may be assembled from warp end yarns and fill pick yarns woven together with one another, wherein either:

(i) the fill pick yarns in the narrow segments comprise the first yarn (and, typically the warp end yarns in the narrow segments comprise the second yarn); or (ii) the warp end yarns in the narrow segments comprise the first yarn (and, typically, the fill pick yarns in the narrow segment comprise the second yarns).

In some embodiments, the warp end yarns extend from the top edge portion to the bottom edge portion, the fill pick yarns extend from the left side portion to the right side portion, and the fill pick yarns in the narrow segments comprise the first yarn (and, in some embodiments, the fill pick yarns in the wide segments comprise the second yarn; and preferably, the warp end yarns in both the wide segments and the narrow segments comprise the second yarn).

The fabric may be woven in a plain weave, satin weave, or twill weave pattern. In some embodiments, the fabric is woven in a plain weave. See, e.g., U.S. Pat. No. 8,230,537.

In general, the first (high strength) yarn comprises, consists essentially of, or consists of liquid crystalline polymer fibers, typically thermoset liquid crystalline polymer fibers, and in some embodiments preferably aromatic (including wholly aromatic and mixed aromatic and aliphatic), thermoset, liquid crystalline polymer fibers.

In some embodiments, the first yarn comprises, consists essentially of, or consists of aromatic polyester fibers (e.g., VECTRAN® fibers), polyoxazole fibers, including poly(p-phenylene-2,6-benzobisoxazole) (or "PBO") fibers, such as ZYLON® fibers (available from Toyobo Corp.), fibers, aramid (e.g., KEVLAR®, TECHNORA®, and TWARON®) fibers, polyether ether ketone (PEEK) fibers, polyetherimide (e.g., ULTEM®) fibers, ultra-high molecular weight polyethylene fibers (e.g., DYNEEMA® fibers, SPECTRA® fibers; see, e.g., U.S. Pat. Nos. 5,972,484 and 8,808,602), polyarylate fibers (e.g., ZXION® fibers), high-performance polyethylene fibers (e.g., TSUNOOGA™ fibers) and/or polyphenylene sulfide (PPS) fibers.

In some embodiments, the first yarn comprises, consists essentially of, or consists of repeating units of Formula I and Formula II:

(I)

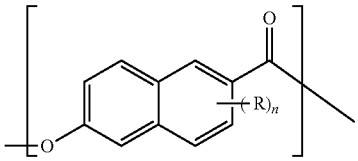

(II)

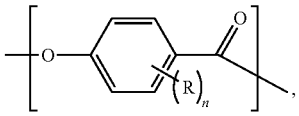

wherein n is 1, 2 or 3, and each R is independently H, C1-C4 alkyl, C1-C4 alkoxy, or halo (e.g., fluoro, chloro, bromo, or iodo).

In some embodiments, the first yarn comprises, consists essentially of, or consists of wholly aromatic polyester liquid crystalline fibers, the fibers consisting essentially of repeating units of Formula I and Formula II:

(Ia)

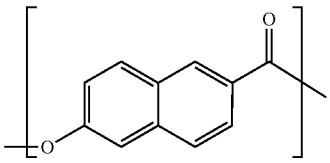

(IIa)

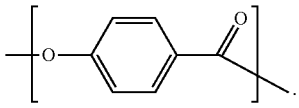

Such yarns and fibers are known and are described in, for example, U.S. Pat. No. 4,067,852 and US Patent application Publication No. US 2012/0021218.

In some embodiments, the first yarn is characterized by one, two, three, or all of the following:

has a denier of from 150 or 200 to 250 or 300 (e.g., 200); and/or comprises, consists essentially of or consists of from 20 or 30 to 50, 60, 100, 170, or 200 fiber filaments per yarn (e.g., 40 filaments per yarn; 166 filaments per yarn), or more; and/or has a breaking load of from 3,000 or 4,000 grams per yarn to 6,000 or 12,000 grams per yarn (e.g., 5,180 grams per yarn), or more; and/or has a percent elongation at break of from 1 or 2 percent to 3, 4, 5, 6 or 8 percent (e.g., 2.8 percent), or more; and/or has a tenacity of 10 or 15 to 30, 40, 50 or 60 grams per denier (e.g., 44 grams per denier), or more; and/or has a tensile strength of from 250 or 300 to 400, 500, 600, 1,200, or 1,400 (e.g., 354; 1,170) pounds per inch, or more; and/or has a percent elongation (or "creep") of less than 1, 2, or 4 percent (e.g., 0.6 percent) after 100 hours at room temperature at thirty percent of its breaking load.

In some embodiments, the first yarn is tinted (e.g., yellow or gold), as is the case for VECTRAN™ yarn.

In the fabrics, sheets and/or devices of the present invention, the second yarn (when present) may comprise, consist of, or consist essentially of polyester fibers, nylon fibers, or a combination or blend of polyester and nylon fibers.

For example, the second yarn may comprise, consist essentially of, or consist of polyethylene terephthalate (PET) fibers (e.g., a high tenacity, low elongation polyethylene terephthalate yarn), nylon 66 fibers (e.g., a high tenacity, low elongation poly(hexamethylene adipamide) yarn), nylon 6 fibers (e.g., a high tenacity, low elongation polycaprolactam yarn), or combinations or blends of polyester and nylon fibers. Such materials, which include copolymers of PET, are known and are described in, for example, U.S. Pat. No. 5,234,764 to Allied Signal.

In some embodiments, the second yarn consists of at least 90 percent by weight of polyester (e.g., polyethylene terephthalate) fibers, or nylon 66 (e.g., poly(hexamethylene adipamide)) fibers, nylon 6 fibers (e.g., polycaprolactam), or blends of polyester fibers and nylon fibers.

In some embodiments, the second yarn may be characterized by one, two, three, or all of the following:

a denier of from 150 or 200 to 250 or 300 (e.g., 220); and/or comprises, consists essentially of, or consists of from 20 or 30 to 40, 50 or 60 fiber filaments per yarn (e.g., 35 filaments per yarn), or more; and/or has a breaking load of from 1,000 to 2,000 grams per yarn (e.g., 1,650 grams per yarn), or more; and/or has a percent elongation at break of from 10 or 20 to 40 or 50 percent (e.g., 26 percent), or more; and/or has a tenacity of at least 6 or 7 grams per denier (e.g., 7.5 grams per denier), or more; and/or has a tensile strength of from 150 or 200 to 300 or 400 (e.g., 230) pounds per inch, or more; and/or has a percent elongation (or "creep") of less than 10, 15 or 20 percent after 100 hours at room temperature at thirty percent of its breaking load.

In some embodiments, the second yarn is white.

Fabrics of the present invention may be selected such that the denier of the first yarn is not more than 10, 20 or 30 percent different from (greater than or less than) the denier of the second yarn.

In some embodiments, the woven fabric comprises, consists essentially of, or consists of from 50, 60, 70, 80, 90, 92, or 94 percent by weight to 98, 99 or 100 percent by weight of the first yarn; and from 0, 1 or 2 percent by weight to 6, 8, 10, 20, 30, 40, or 50 percent by weight of the second yarn.

In some embodiments, the woven fabric comprises, consists essentially of, or consists of from 50, 60, 70, 80, 90, 92, or 94 percent by weight to 98 or 99 percent by weight of the second yarn; and from 1 or 2 percent by weight to 6, 8, 10, 20, 30, 40, or 50 percent by weight of the first yarn.

In some embodiments that include wide and narrow segments, the first yarn is included in the narrow segments, in the direction oriented with those segments, from left side to right side, in a number of from 20 or 30 to 40 or 60 per narrow segment, and in a density of from 20 or 30 to 40 or 60 yarns per inch (as either warp or fill yarns; and preferably with all of the first yarns positioned immediately adjacent one another, whether in the warp or fill direction).

In some embodiments that include wide segments, the second yarn is included in the wide segments, in a direction oriented with those sections, from left side to right side, in density of from 20 or 30 to 40 or 60 yarns per inch (as either warp or fill yarns).

In some embodiments that include narrow segments, the second yarn is included in both the narrow segments and the wide segments, in the direction oriented across the wide and narrow segments from top to bottom, in a density of from 20 or 30 to 40 or 60 yarns per inch (as either fill or warp yarns).

A bed sheet of the present invention may, in general, be dimensioned for placement over a mattress with the top edge portion positioned below the head portion of the mattress and the bottom edge portion positioned beneath the foot portion of the mattress.

In some embodiments, the woven fabric is: from four or five feet wide to seven or eight feet wide (from the left edge portion to the right edge portion), and/or from six or seven feet long to eleven or twelve feet long (from the top edge portion to the bottom edge portion).

In some embodiments, the narrow segments (when included) are from 0.4 or 0.7 inches wide to 1.5 or 2 inches wide (e.g., 1 inch wide).

In some embodiments, the wide segments (when included) are from 8 or 10 inches wide to 15 or 18 inches wide (e.g., 12 inches wide).

In any one sheet, the wide and narrow segments may be the same width throughout, or may vary in width, depending upon the lifting mechanism and lifting requirements.

Typically, a sheet of the present invention further includes a plurality of flexible handle straps (e.g., formed from polyester webbing or braid) connected to each of the left side edge portion and the right side edge portion, optionally oriented parallel therewith (e.g., and overlying each of said left side edge portion and right side edge portion), and may be connected (e.g., by sewing) where the narrow segments intersect the left and right side edge portions.

In addition, the sheet may include a plurality of flexible securement straps (or lifting straps) (e.g., formed from polyester webbing or braid) connected to the left and right side edge portion, and/or the top and bottom edge portions, optionally extending outwardly therefrom (e.g., perpendicularly or at an angle), and may be connected (e.g., by sewing) where the narrow segments intersect the left and right side edge portions, and/or with a narrow segment overlying or corresponding to each of the top and bottom edge portions.

Note that the straps are sewn at or to the edge portions in a manner such that they form a frame defining and surrounding a central region of the sheet upon which a patient may lie, said central region free of underlying supports (e.g., webs, straps, or mesh), and may consist of a single layer of the fabric.

Webbing, straps or handles may be fixed to the fabric by any suitable technique, typically by sewing with thread (see, e.g., U.S. Pat. No. 5,442,821). A suitable thread is polyester and/or nylon thread, which thread may optionally be treated with an antimicrobial agent as discussed above.

Note also that lifting straps may be sewn to the edge portion where the narrow segments extend into the edge portions, so that tension from the straps is transmitted to the higher strength narrow segments during lifting.

In some embodiments, the sheet (optionally including straps, handles, and sewing thread) consists of one hundred percent polyester, nylon, or blend of polyester and nylon.

Sheets of the present invention, including the fabrics, and webbing, straps, and thread, may be provided with an antimicrobial treatment by any of a variety of techniques. Numerous techniques are known and described in, for example, U.S. Pat. Nos. 3,699,958; 4,919,998; 5,079,044; 5,700,742; 6,024,823; 7,045,673; 7,709,694; 7,790,217; 8,183,167 (the disclosures of which are incorporated by reference herein in their entirety); and others. The antimicrobial compound may be topically applied and/or inherently available in (e.g., impregnated in) the fabric. Topically applied compounds may be covalently coupled to the fabric (e.g., an organosilane). Examples of antimicrobial compounds include, but are not limited to, include metal nanoparticles (e.g., silver, copper, platinum, etc.); quaternary ammonium compounds (including those covalently coupled to the fabric, such as by a silane base coupling agent), triclosan, metals including metal salts and oxides, chitosan, cyclodextrins, etc. See generally Sheila Shahidi and Jakub Wiener, *Antibacterial Agents in Textile Industry* (2012).

In some embodiments, the antimicrobial compound may be a topically applied silyl compound containing a quaternary ammonium group, such as 3-trimethoxy silyl propyl dimethyl octadecyl ammonium chloride (e.g., available as AEGIS® Antimicrobial, Microban International, Ltd.).

In some embodiments, an antimicrobial compound, such as silver, may be applied to the textile as a combination of a polymer and a silver compound or particle, such as SILVADUR™ ET (Dow Chemical Company). Still other alternatives for providing an antimicrobial surface treatment or finish are described in U.S. Pat. Nos. 7,390,774; 8,962,027; 8,900,624; and 8,858,926, the disclosure of which is incorporated by reference.

In some embodiments, the antimicrobial compound, such as silver nanoparticles, may be coextruded with the polymers into the fibers of the yarns from which the fabric is formed, such as described in U.S. Pat. No. 8,183,167.

Different antimicrobial treatments as described above may be applied to or incorporated into the fabrics, threads, and/or webs individually, and/or in combination with one another, in the products described herein.

The sheets and/or devices described above may be put to use in a method of moving an immobile person from a bed mattress, by:

(a) positioning a bed sheet as described above between the person and the mattress;

(b) optionally maintaining the person on the sheet for a time sufficient for that person to rest and/or sleep; then (c) optionally coupling the sheet to a mechanical hoist; and then (d) lifting the person on the sheet from the mattress or floor, or repositioning the person on the sheet on the mattress (for repositioning, where it may not be required to entirely lift the person, sufficient force may be achieved by one or several care providers grasping the side handles and manipulating the sheet in a coordinated manner).

The person may remain on the bed sheet for a suitable time, such as overnight, or for at least one day, or until the bed sheet requires replacement due to soiling.

In ongoing use in a hospital or other care facility, they may next:

(e) optionally returning the sheet to the mattress (e.g., with the patient thereon);

(f) remove the sheet from the mechanical hoist or mattress;

(g) launder the sheet in a conventional manner, such as in a rotating drum washing machine (e.g., a front, top, or side loading washing machine); and then (h) dry and optionally package the sheet; and then (i) return the sheet to the same or different mattress, upon which the same or different person may rest or sleep (that is, repeat step "a" above).

The sheet and/or device described above may have one or more unique identifier tags (e.g., an RFID tag, a bar code tag, etc.) connected thereto. Multiple unique identifiers, all matching one another, may be connected to the sheet or apparatus at multiple locations, such as opposite sides, each corner, etc., to facilitate locating and reading thereof. The sheet may then be electronically scanned or "read" upon occurrence of various events, which event may then be entered into an electronic database for that sheet. For example, the method may further comprise one or more of: (j) electronically reading the unique identifier tag upon each positioning step "(a)" and storing each occurrence of that step for that sheet or device in an electronic database; and/or (k) electronically reading the unique identifier tag upon each said positioning or repositioning step "(d)" and storing each occurrence of that step for that sheet or device in the electronic database; and/or (l) electronically reading the unique identifier tag upon each laundering step "(g)" and storing each occurrence of that step for that sheet or device in the electronic database. In some embodiments, one or more unique identifier tags (e.g., RFID(s)) may be used to detect and/or identify the sheet or device from a distance, such as, e.g., from 4, 5, 6, 7, 8 or more feet away. In some embodiments, one or more unique identifier tags on an individual sheet and/or device may be detected and/or identified even when in close proximity to one or more sheets and/or devices containing one or more unique identifier tags. For example, an individual sheet comprising an RFID tag may be detected and/or identified apart from different sheets and/or items comprising an RFID tag. In some embodiments, a scan of the cart may obtain and/or capture the ID numbers for every item on the cart. Other events, such as staining of the sheet, testing of antimicrobial properties of the sheet, weight loss of the sheet, etc., may also be recorded into the database. Medical inventory database systems and apparatus for carrying out such techniques are known and can be implemented in accordance with known techniques (see, e.g., U.S. Pat. Nos. 7,218,231; 7,990,272; 8,114,063; and 8,346,632).

An illustrative embodiment of the invention is a fabric constructed from 100% polyester low-elongation continuous-filament high-tenacity yarns in both machine and cross-machine directions. (In some embodiments, the polyester yarn is a 220 denier continuous-filament yarn with 35 filaments per yarn, and a breaking load of 1,650 grams per yarn and 26.0% elongation at break.) The fabric incorporates ultra-high strength bands of yarns woven in a one-inch section of yarns in the cross machine direction, spaced at twelve-inch intervals, comprised of Vectran® fibers, a liquid crystal polymer yarn produced by Kuraray. Vectran® is a high-performance multifilament yarn, which exhibits exceptional strength at very low weight. (In some embodiments, the Vectran® yarn is a 200 denier yarn with 40 filaments, and a breaking load of 5,180 grams per yarn and 2.8% elongation at break.) Note that the polyester and Vectran® yarns are of similar denier, so that the resulting fabric, when woven in a plain weave construction, has the same thickness throughout. When used in one-inch stripes as part of the novel fabric's woven structure, Vectran® combines with the high-tenacity, low-elongation polyester yarns to produce unexpected performance as the foundation of a high-performance patient lifting/repositioning device to meet the design criteria outlined above for patient lifting/repositioning devices.

In some embodiments, a one-inch stripe in a fabric of the present invention may be woven with alternating picks of the first and second yarns (also referred to as "pick-and-pick filling insertion"). In some embodiments, a method of forming a fabric of the invention comprises inserting alternating yarns in one-inch stripes that are spaced twelve inches apart in the machine direction. Ultra-high strength yarns (e.g., Zylon) may be used in a fabric and may increase the strength of the one-inch support stripes by weaving alternating picks of the ultra-high strength yarn and a lower-strength yarn to form the one-inch support stripe. This may reduce the cost associated with forming the fabric, while still achieving exceptional strength (e.g., at least 645 lbs. per inch when an ultra-high strength yarn, such as, e.g., Zylon, is used in this way).

Figure 1B:
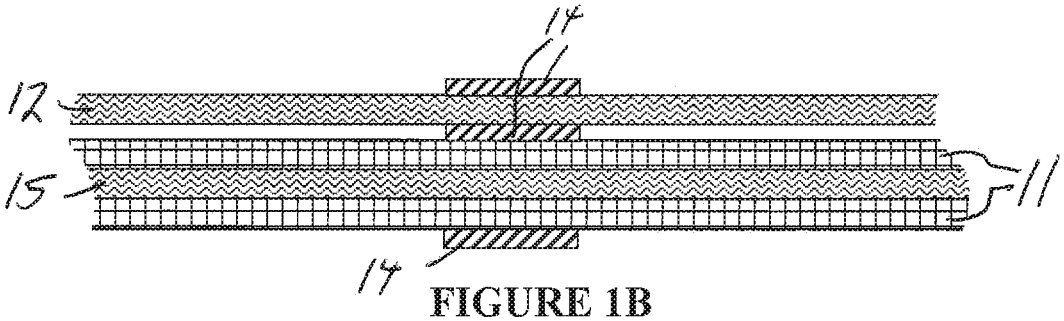
FIG. 1B. A side sectional view of a portion of the embodiment of FIG. 1A, taken along line B'-B' of FIG. 1A.
Figure 1C:
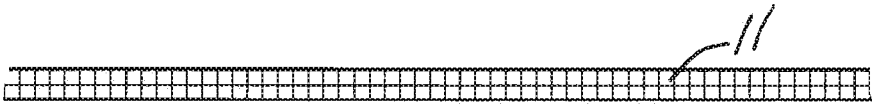
FIG. 1C. A side sectional view of a portion of the embodiment of FIG. 1A, taken along line C'-C' of FIG. 1A.

A schematic illustration of a first embodiment of a lifting/repositioning device incorporating a first embodiment of a fabric of the invention is set forth in FIG. 1. Yarns comprised of high strength fibers such as Vectran® fibers are woven as an integral part of the fabric 11 across the fabric's length and/or width dimension. Optionally, a lower strength, second yarn as described above may optionally be included in the fabric, in either the length and/or width dimension. The high strength fibers replace the webbing in traditional lifting/repositioning devices. The illustrated lifting/repositioning device incorporates handles 12, made (for example) of one-inch braided webbing and affixed (for example) by sewing along the device's sides, and loop straps 13 sewn at intervals along the device's sides to facilitate repositioning/transferring a patient either by hand or by attachment to an overhead hoist. Stitching 14 is represented by cross-hatched regions. A reinforcing web or segment 15 may be included on the opposite side of the edge portion, as shown in FIG. 1B. Of course, this does not intrude into or underlie the central area of the sheet upon which the patient reclines (defined by the edge portions, which together with the various straps or web or woven belts and stitching create a frame for the central area), which central area supports the patient, and which central area is a single ply material which is free of underlying straps, mesh, or other supporting structures, as shown in FIG. 1C.

A schematic illustration of a second embodiment of a lifting/repositioning device incorporating a second embodiment of a fabric of the invention is set forth in FIG. 2. The support stripes (narrow segments) of Vectran® fibers are woven as an integral part of the fabric across the fabric's width and located at 12" intervals along the length of the device with wide segments 10 and narrow segments or stripes 11 in an alternating pattern. The positions of the woven-in support stripes are designated to replace the webbing in traditional lifting/repositioning devices. The illustrated lifting/repositioning device incorporates handles 12, made (for example) of one-inch braided webbing and affixed by (for example) sewing along the device's sides and loop straps 13 sewn at intervals along the device's sides to facilitate repositioning/transferring a patient either by hand or by attachment to an overhead hoist. The loop straps are sewn at opposite ends of alternating support stripes. Stitching 14 is represented by cross-hatched regions. A reinforcing web or segment 15 may be included on the opposite side of the edge portion, as shown in FIG. 2B. Of course, this does not intrude into or underlie the central area of the sheet upon which the patient reclines (defined by the edge portions, which together with the various straps or web or woven belts and stitching create a frame for the central area), which central area supports the patient, and which central area is (as in the embodiment of FIGS. 1A-1C), a single ply material which is free of underlying straps, mesh, or other supporting structures, as shown in FIG. 2C.

Figure 2B:
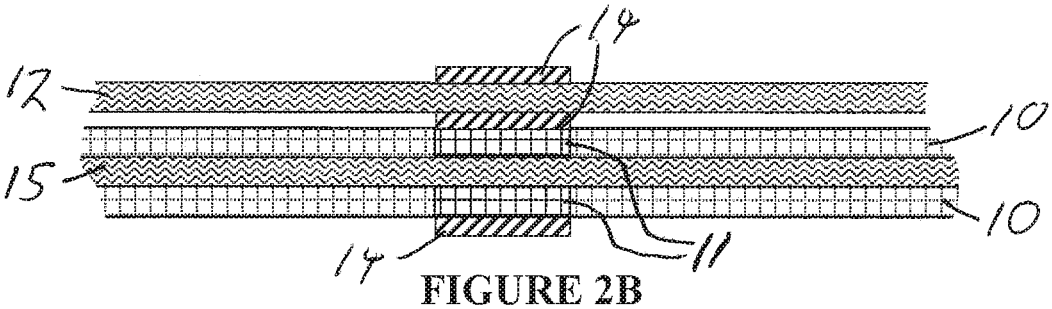
FIG. 2B. A side sectional view of a portion of the embodiment of FIG. 1A, taken along line B'-B' of FIG. 2A.
Figure 2C:
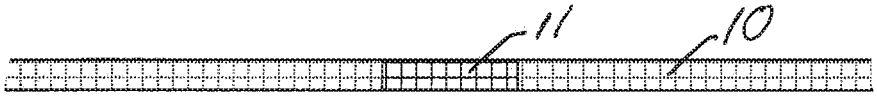
FIG. 2C. A side sectional view of a portion of the embodiment of FIG. 2A, taken along line C'-C' of FIG. 2A.
Figure 2D:
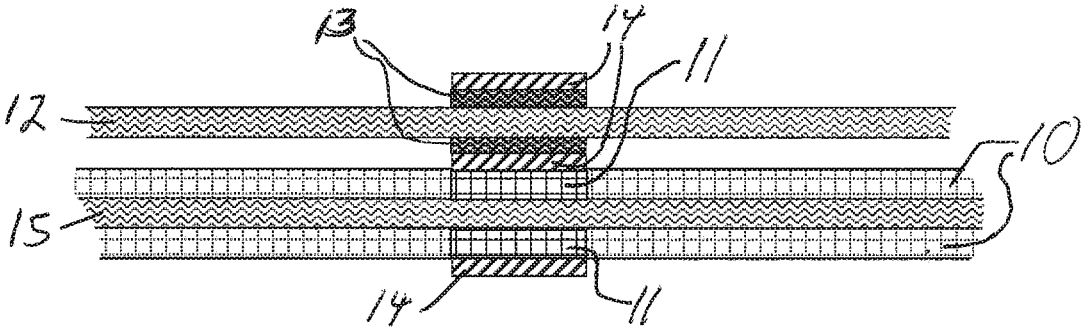
FIG. 2D. A side sectional view of a portion of the embodiment of FIG. 2A, taken along line D'-D' of FIG. 2A.

FIG. 2D shows that lifting straps (which may also serve as securement straps) are connected to the fabric in the illustrated embodiment at a narrow band thereof so that the lifting straps are directly connected to a portion of the fabric containing high strength fibers. This feature serves to reduce the chance of catastrophic failure of the lifting device when it is used to lift heavier patients or subjects (though the user should always proceed with reasonable precautions, particularly when lifting heavier patients). Fastening of various materials may be carried out by any suitable technique, including through stitching (schematically illustrated), etc.

Figure 2A:
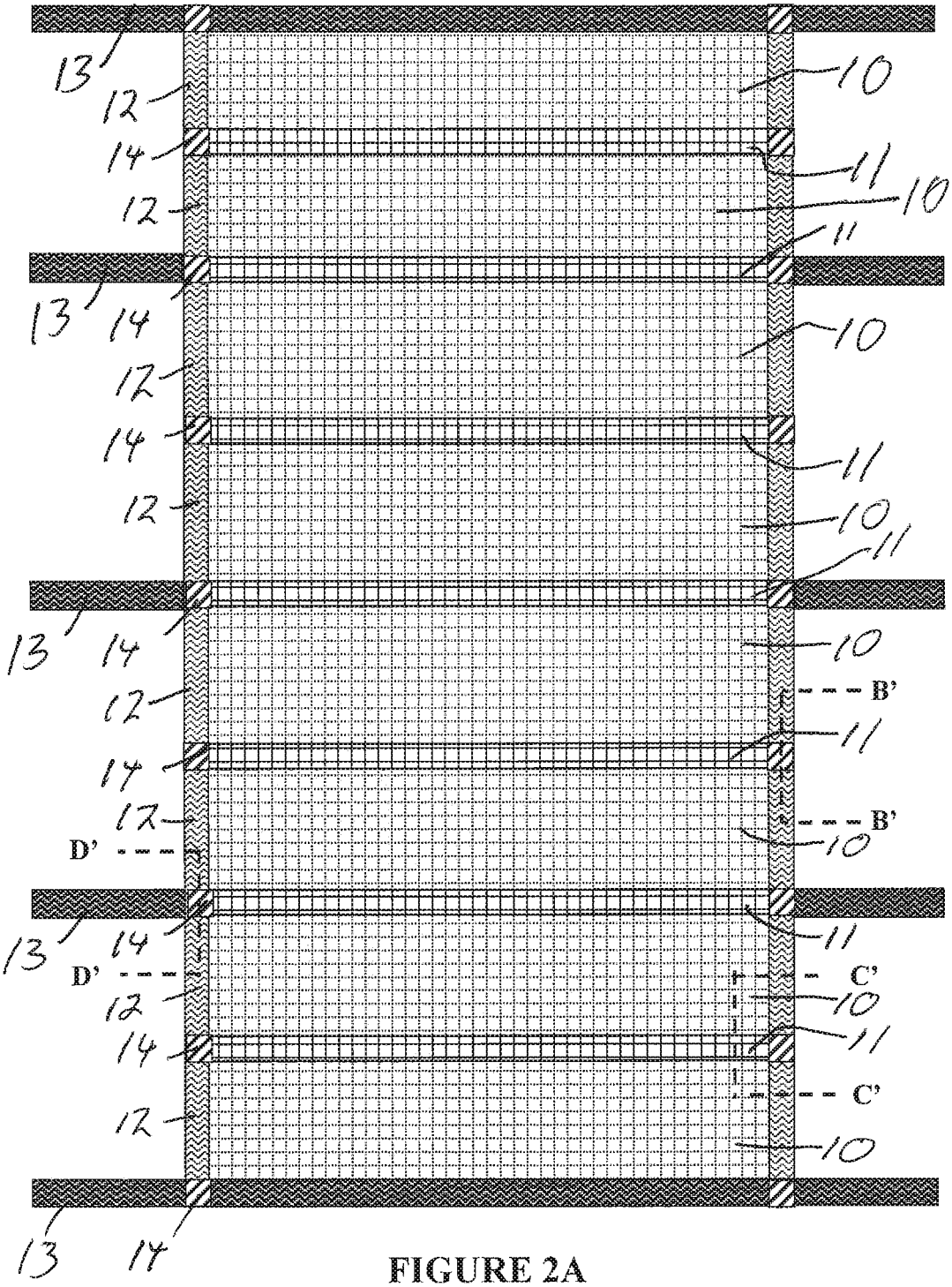
FIG. 2A. A second illustrative embodiment of a lifting and repositioning sheet using one embodiment of a fabric of the present invention.
Figure 3:
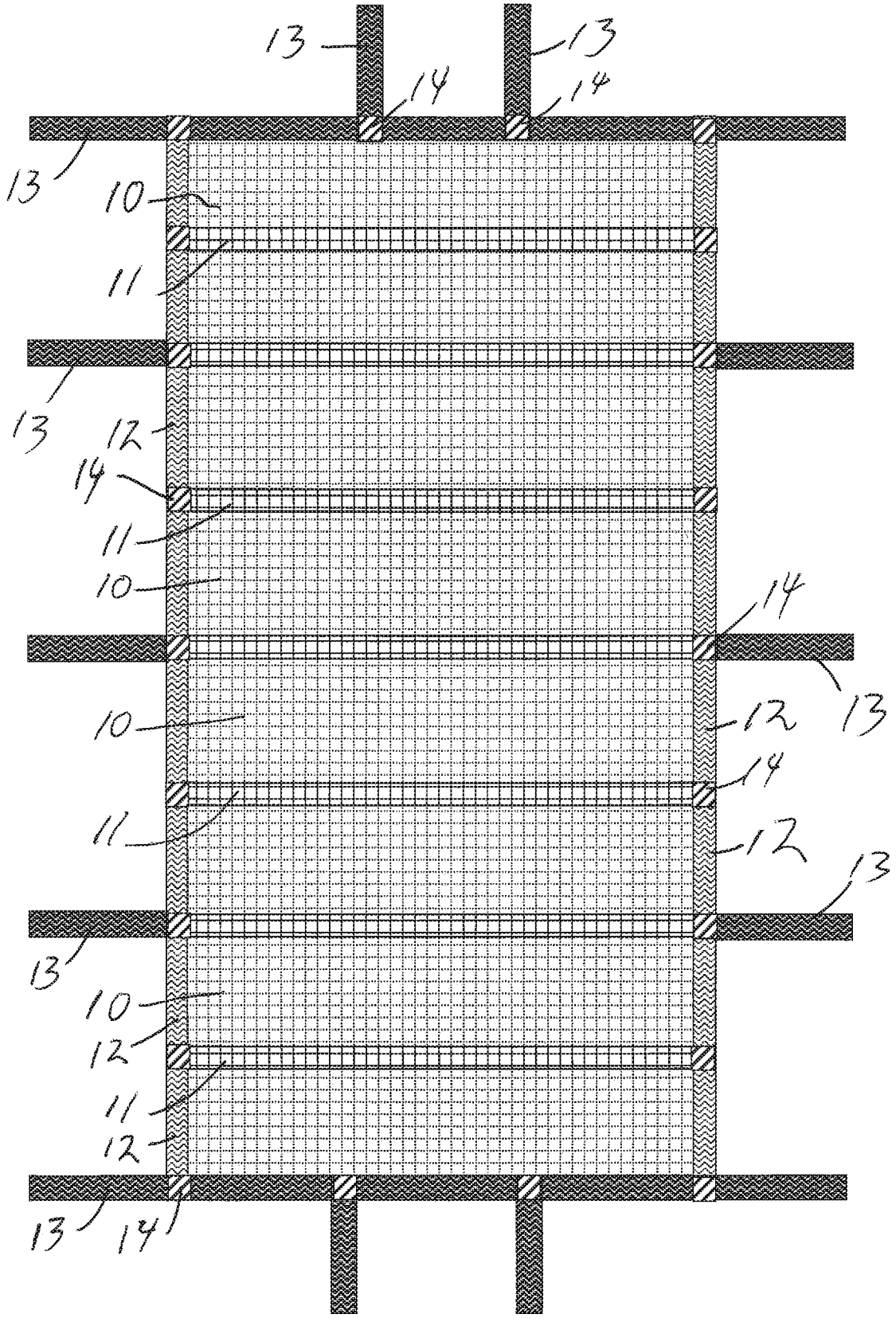
FIG. 3. An illustrative example of a lifting and repositioning sheet with two top and two bottom attachments, using one embodiment of a fabric of the present invention.
Figure 4:
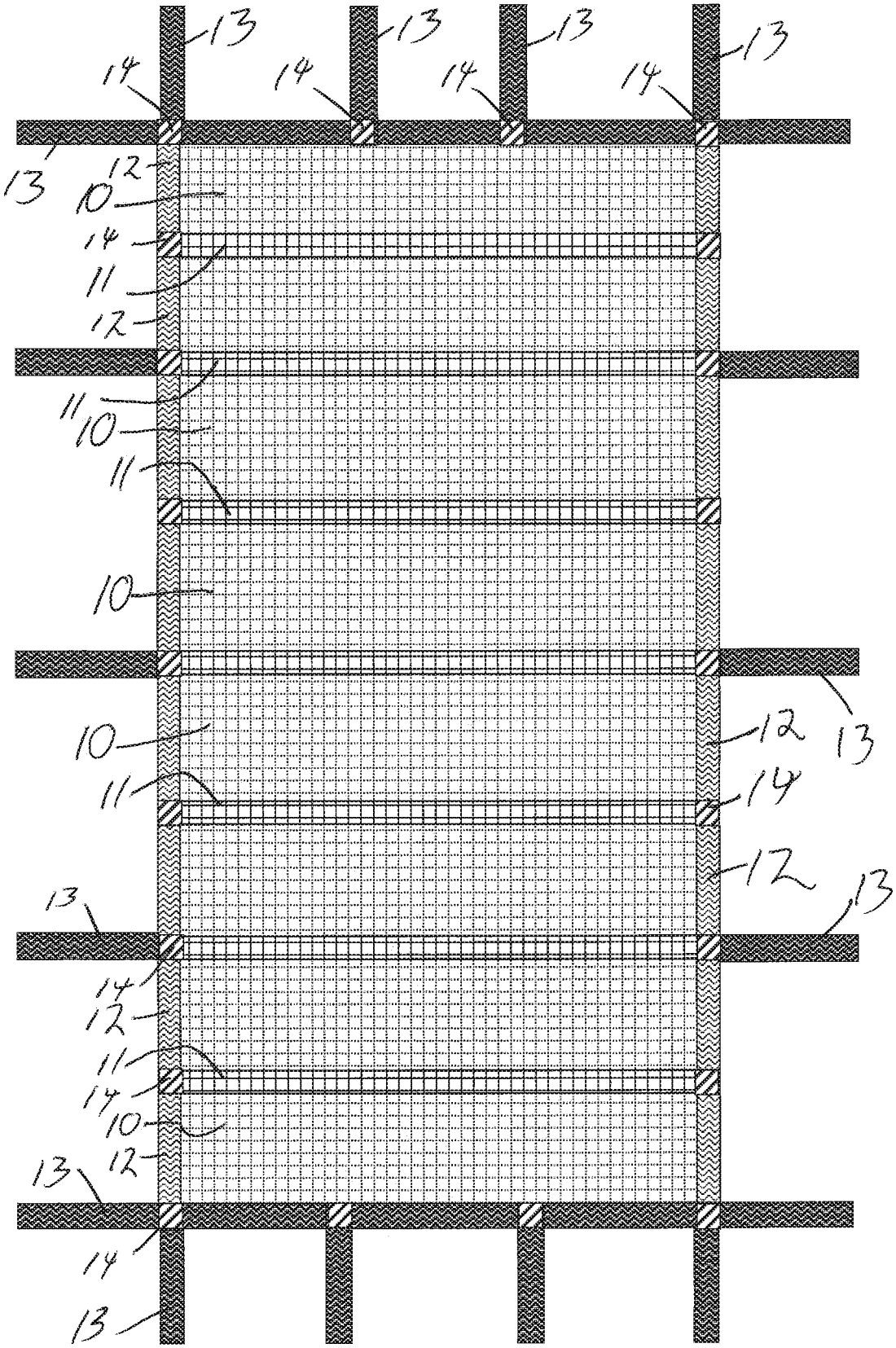
FIG. 4. An illustrative embodiment of a lifting and repositioning sheet with four top and bottom attachments, using one embodiment of a fabric of the present invention.
Figure 5:
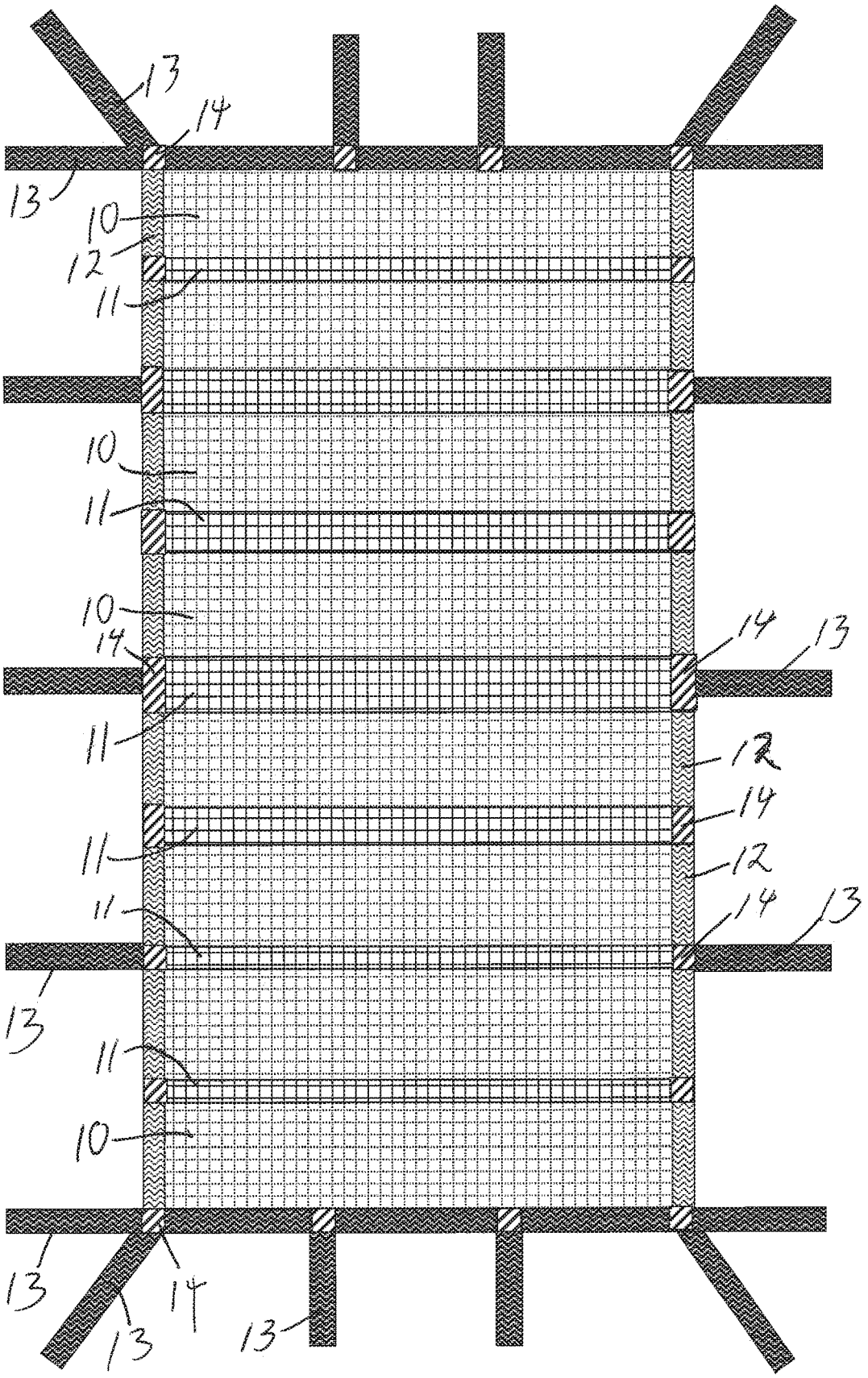
FIG. 5. An illustrative embodiment of a lifting and repositioning sheet with four top and bottom attachments, with angled corners, using one embodiment of a fabric of the present invention.

Three other lifting sheet configurations using the fabric invention are shown in FIGS. 3, 4 and 5. Like features to those shown in FIGS. 2A-2C are shown by like fill of corresponding regions (dashed or solid check; dark or light wavy lines; cross-hatch).

The unique configuration of high-tenacity low-elongation polyester yarns, with woven-in support stripes integral to the fabric weave, may create a fabric which, in some embodiments, may have:

- High strength and low elongation where it is most needed to support the patient;
- Low friction and/or low abrasion between the patient's skin and the support surface; Continuous-filament yarns woven in a plain weave construction to form a fabric that is low friction and meets a coefficient of friction of ≤0.35, low friction surface, has been shown in clinical trials to manage friction and shear forces in such a manner to significantly reduce the development of pressure ulcers;
- A fabric construction which allows the elimination of webbing sewn-on to the underside of the lifting/repositioning device, making lifting/repositioning devices lighter in weight and less bulky;
- Continuous-filament non-linting yarns produce a lifting/repositioning device with a low potential for contamination during use from airborne particles or particles transferred by skin contact;
- Enhanced moisture management, wicking of liquids and moisture vapor, and a drying rate superior to incumbent devices; Continuous-filament yarns woven in a plain weave construction to form a fabric that achieves a drying rate for water-saturated fabric of >90% dryness after 45 minutes has been shown in clinical trials to manage moisture and reduce the coefficient of friction in such a manner to significantly reduce the development of pressure ulcers;

Enhanced durability to continued use and repeated institutional laundering and drying;

Antimicrobial properties. The fabric may incorporates a surgical-grade durable antimicrobial treatment which protects the novel fabric from odor-causing germs and bacteria, maintaining freshness and providing a cleaner support surface; and/or Ease of cleaning and laundering. The combination of yarns and fabric design may enable the lifting/repositioning device to be laundered with the same washing equipment used for cleaning conventional healthcare bedding, while achieving more efficient cleaning action and disinfection than is possible with traditional lifting/repositioning devices using current cleaning methods.

A comparison of fabric performance properties between the incumbent lifting/positioning device (Column A) and a fabric of the present invention with Vectran® fibers as the first yarn (Column B) is shown in Table 2 below. Performance improvements are provided in Column C.

TABLE 2

Performance properties of a traditional lifting/repositioning device, compared with a lifting/repositioning device fabricated according to an embodiment of the invention.

| Properties | A Traditional Lifting Sling with Straps | B New Lifting Sheet With Vectran ® | C % Improvement with New Lifting Sheet | D Test Method |
|---|---|---|---|---|
| | | Fiber Blend | | |
| Base Fabric | 100% Cotton | 96% Polyester/4% Vectran ® | n/a | ASTM-D-629 |
| | | Weight (ounces per sq. yard) | | |
| Base Fabric | 4.5 | 3.2 | −29% | ASTM-D-3776 |
| | | Tensile Strength (lbs./inch) | | |
| Base Fabric | 24 | 232 | +867% | ASTM-D-5034 |
| Webbing* or Vectran** | 250* | 354** | +42% | ASTM-D-5034 |
| | | Tear Strength (lbs./inch) | | |
| Base Fabric | 3.5 | 42 | +1,100% | ASTM-D-2261 |
| Webbing* or Vectran** | 45* | 90** | +100% | ASTM-D-2261 |
| | | Seam Strength at Loop Attachment (lbs.) | | |
| Base Fabric | 250 | 293 | +17% | ASTM-D-5034 |
| | | Particle Count (Particles/ft$^3$-min) | | |
| Base Fabric | 243,254 | 257 | −99.9% | INDA IST 160.1 |
| | | Coefficient of Friction | | |
| Base Fabric | 0.21 | 0.25 | +16.0% | Kawabata[1] |
| Webbing* or Vectran** | n/a* | 0.34** | n/a | Kawabata[1] |
| | | Drying Time (% Dryness @ 45 min) | | |
| Base Fabric | 50% | 100% | +100% | see below[2] |
| | | Antimicrobial Properties | | |
| Base Fabric | No | Yes | 100% Anti-microbial | AATCC 100 |
| Webbing* or Vectran** | No* | Yes** | 100% Anti-microbial | AATCC 100 |

[1]The surface properties of friction (resistance/drag) were determined using the Kawabata KES-FB4 Surface Tester. Measurements were made using a standard specimen size of 20 × 20 cm in three replications. Using a calibrated friction probe, coefficient of friction (COF) values of 0 to 1 were determined, with the higher COF value corresponding to higher friction.

[2]A determination of % moisture loss of a fabric until dryness, measured in 15-minute intervals up to 60 minutes, whichever comes first. An 8" × 10" fabric sample was tested at intervals. The rate was calculated based upon the time it takes for the sample to return to its original dry weight.

A comparison of fabric performance properties between the incumbent lifting/positioning device (Column A) and a fabric of the present invention with Dyneema® fibers as the first yarn (Column B) is shown in Table 3 below. Performance improvements are provided in Column C.

TABLE 3

Performance properties of a traditional lifting/repositioning device, compared with a lifting/repositioning device fabricated according to an embodiment of the invention.

| Properties | A Traditional Lifting Sling with Straps | B New Lifting Sheet With Dyneema ® | C % Improvement with New Lifting Sheet | D Test Method |
|---|---|---|---|---|
| | | Fiber Blend | | |
| Base Fabric | 100% Cotton | 96% Polyester/4% Dyneema ® | n/a | ASTM-D-629 |
| | | Weight (ounces per sq. yard) | | |
| Base Fabric | 4.5 | 3.3 | −27% | ASTM-D-3776 |
| | | Tensile Strength (lbs./inch) | | |
| Base Fabric | 24 | 264 | +1,000% | ASTM-D-5034 |
| Webbing* or Dyneema** | 250* | 445** | +178% | ASTM-D-5034 |
| | | Tear Strength (lbs./inch) | | |
| Base Fabric | 3.5 | 34 | +871% | ASTM-D-2261 |
| Webbing* or Dyneema** | 45* | 42** | −7% | ASTM-D-2261 |
| | | Particle Count (Particles/ft$^3$-min | | |
| Base Fabric | 243,254 | 1,323 | −99.5% | IND A 1ST 160.1 |
| | | Coefficient of Friction | | |
| Base Fabric | 0.21 | 0.28 | +33.3% | Kawabata[1] |
| Webbing* or Dyneema** | n/a* | 0.36** | n/a | Kawabata[1] |
| | | Drying Time (% Dryness @ 45 min) | | |
| Base Fabric | 50% | 100% | +100% | see below[2] |
| | | Antimicrobial Properties | | |
| Base Fabric | No | Yes | 100% Anti-microbial | AATCC 100 |
| Webbing* or Dyneema** | No* | Yes** | 100% Anti-microbial | AATCC 100 |

[1]The surface properties of friction (resistance/drag) were determined using the Kawabata KES-FB4 Surface Tester. Measurements were made using a standard specimen size of 20 × 20 cm in three replications. Using a calibrated friction probe, coefficient of friction (COF) values of 0 to 1 were determined, with the higher COF value corresponding to higher friction.

[2]A determination of % moisture loss of a fabric until dryness, measured in 15-minute intervals up to 60 minutes, whichever comes first. An 8" × 10" fabric sample was tested at intervals. The rate was calculated based upon the time it takes for the sample to return to its original dry weight.

Figure 6:
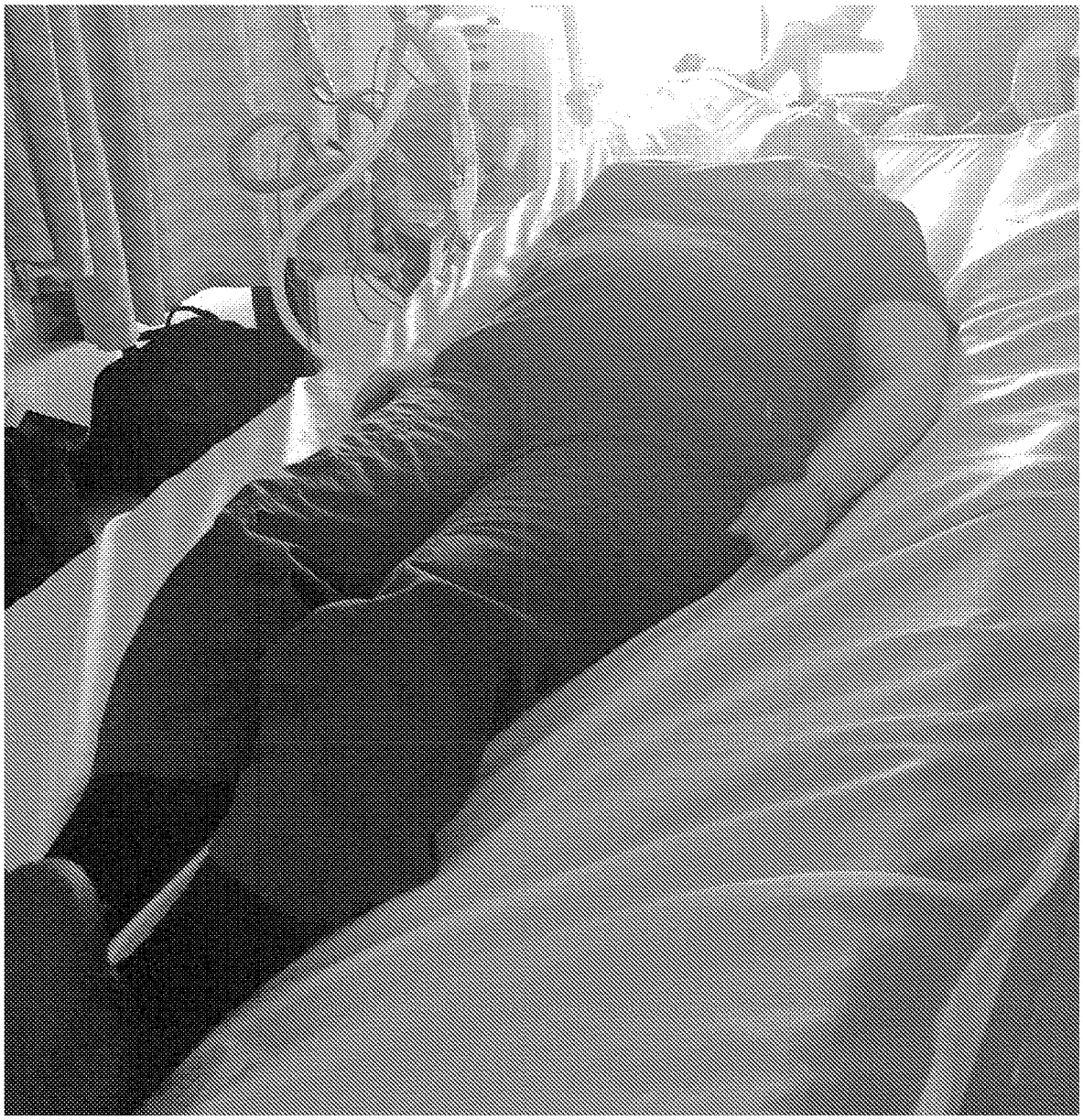
FIG. 6. A first photograph of one embodiment of a lifting and repositioning sheet of the present invention, using an illustrative embodiment of a fabric of the invention. Note: Here, the patient lies on the lifting sheet, using it as they would a conventional bed sheet. The ultra-high strength yarn strips—woven into the fabric construction—do not disrupt the flexible, smooth support surface. The lifting straps hang over the bed's side, maintaining a smooth top surface against the patient's skin.
Figure 7:
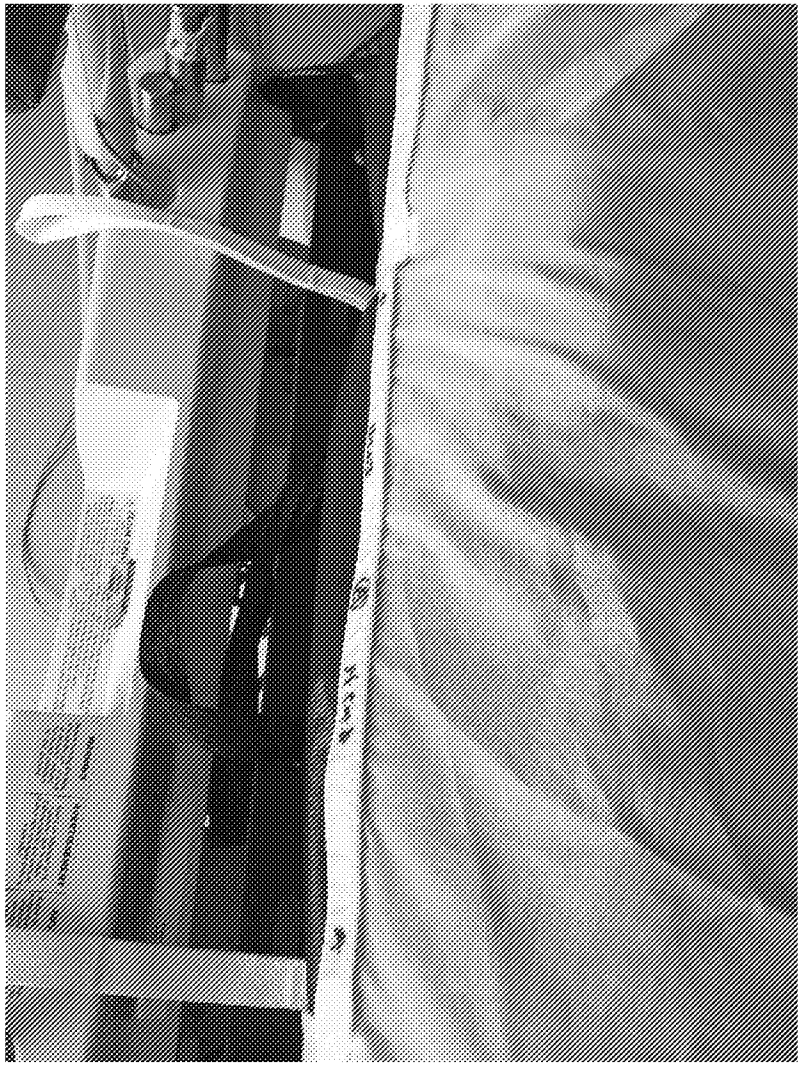
FIG. 7. A second photograph of one embodiment of a lifting and repositioning sheet of the present invention, using an illustrative embodiment of a fabric of the invention. Note: The lifting sheet hangs over the bed's side, maintaining a smooth top surface against the patient's skin.
Figure 8:
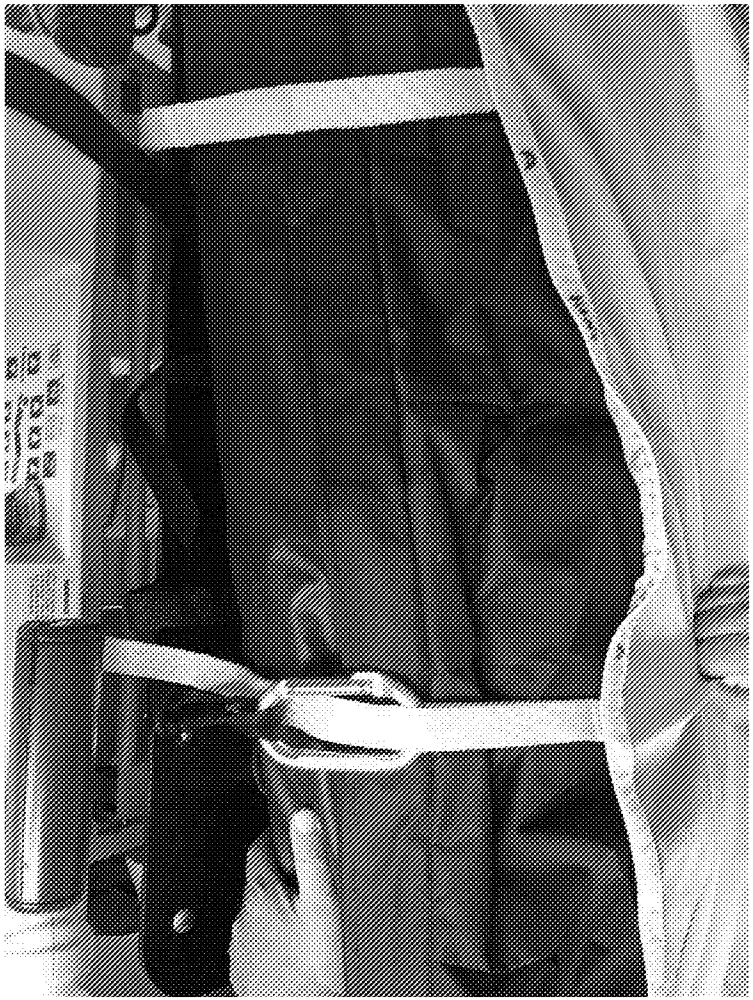
FIG. 8. A third photograph of one embodiment of a lifting and repositioning sheet of the present invention, using an illustrative embodiment of a fabric of the invention. Note: Lifting sheet hangs over the bed's side, and is tethered to the head of the bed using the straps shown in FIGS. 2, 3 and 4.

In use, the lifting/repositioning sheet lies centered over the patient's bed, as seen in FIG. 6. (Note in this image, the nurse was trying to determine the ease of slide downward in the bed, which bunched the fabric up a bit). The braided frame (illustrated in FIGS. 1-5), comprised of handles and loop straps (or lifting straps), hang off each side of the bed, is seen in FIGS. 6 and 7. The loop straps (also part of the braided frame) sewn at the head and foot of the bed in FIGS. 2, 3 and 4 are used to tether the lifting/repositioning sheet to the bed when needed, as seen in FIG. 8.

Figure 9:
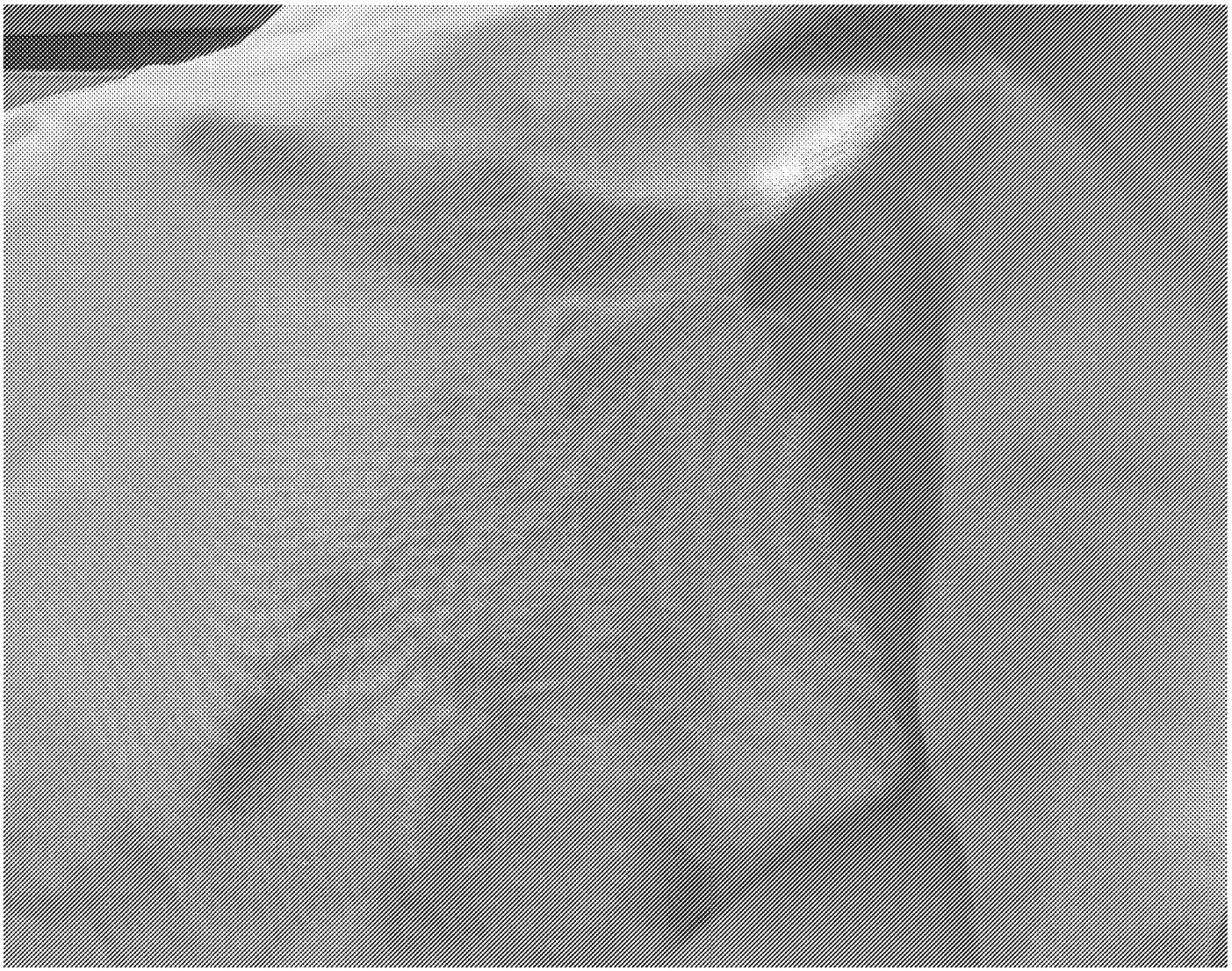
FIG. 9. A first photograph of one embodiment of a fabric of the invention.
Figure 10:
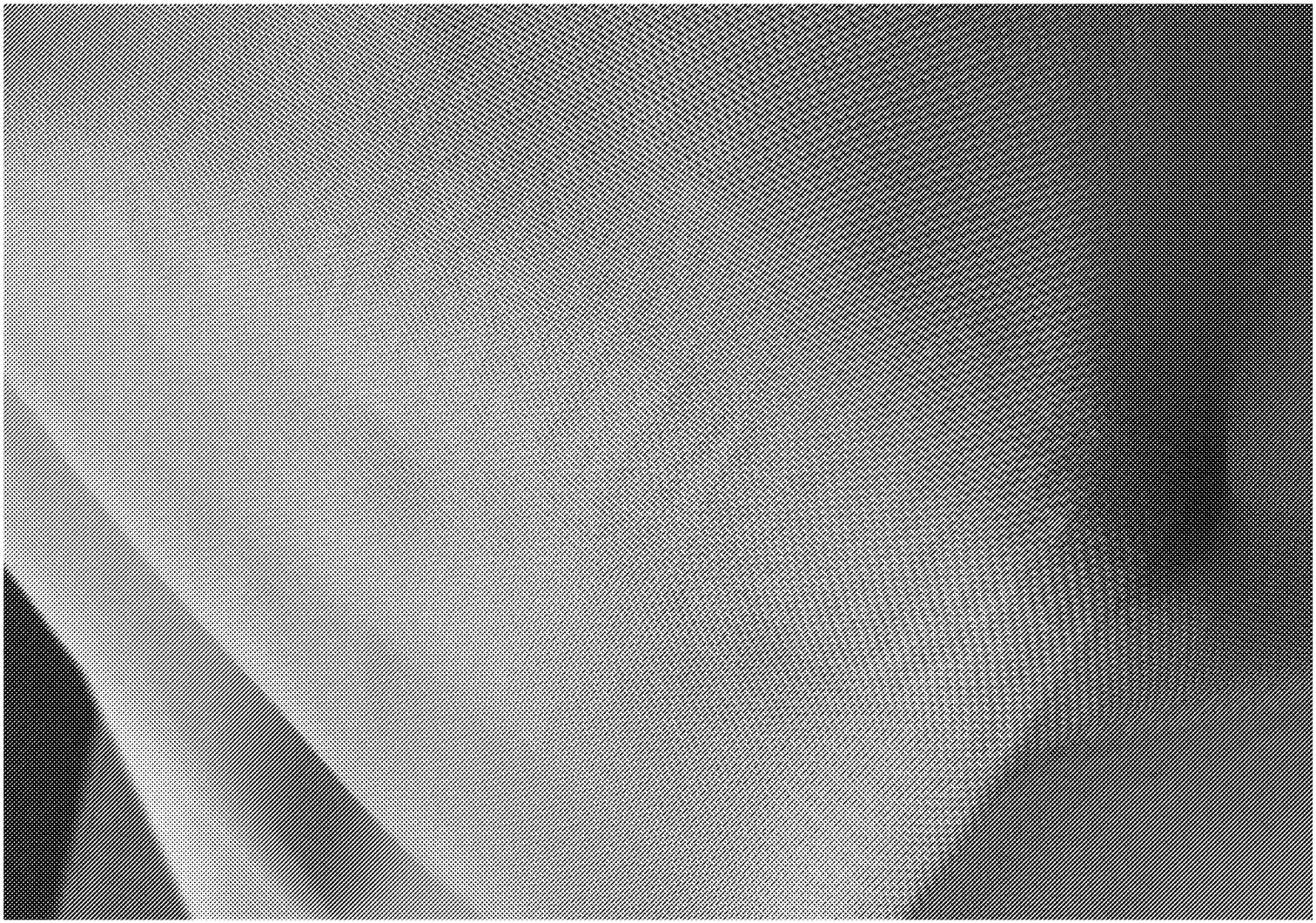
FIG. 10. A second photograph of one embodiment of a fabric of the invention.
Figure 11:
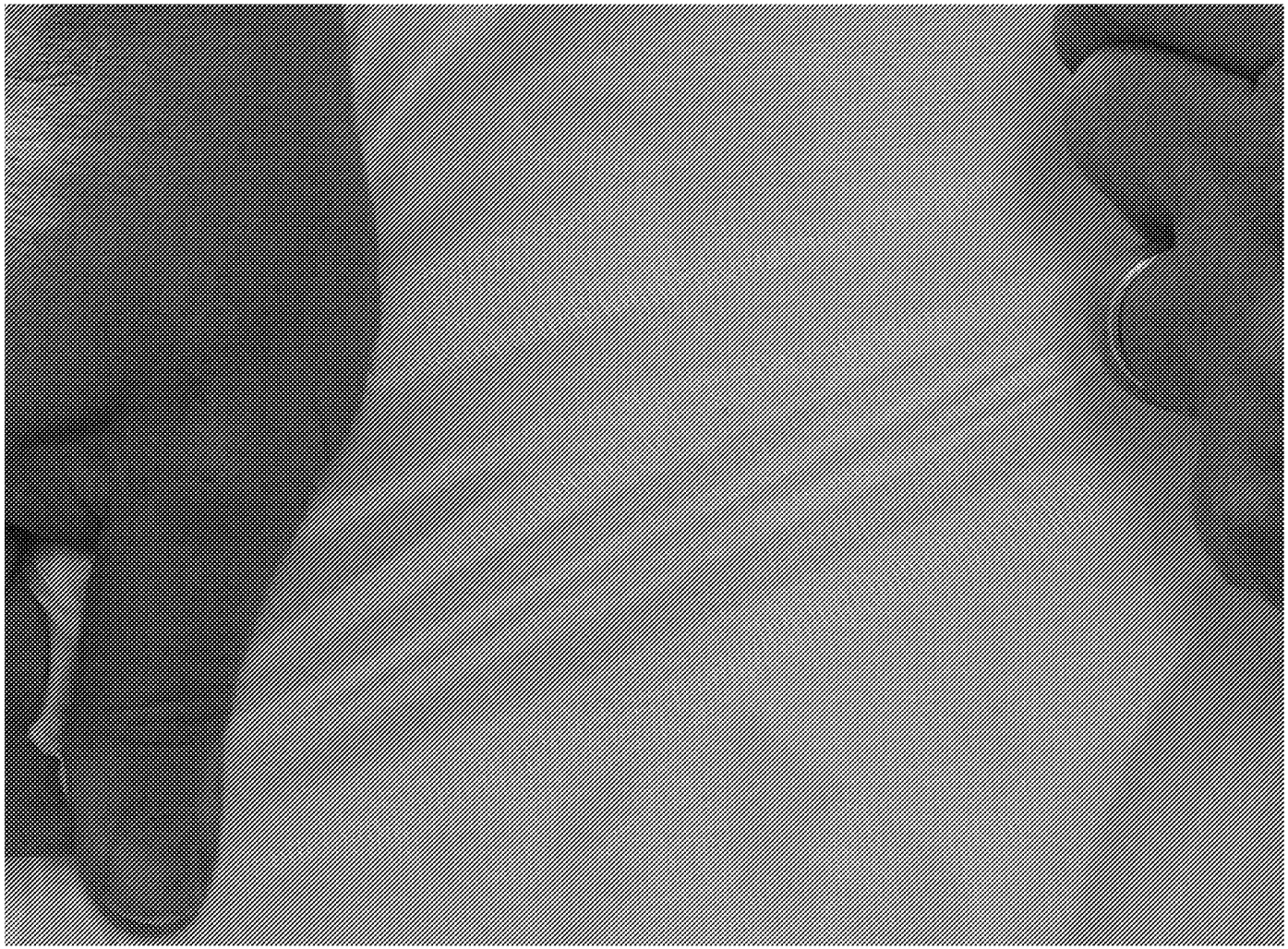
FIG. 11. A third photograph of one embodiment of a fabric of the invention.

The detailed photographs in FIGS. 9-11 illustrate one specific embodiment of a fabric of the invention.

Clinical Trial.

An in-hospital clinical trial with adult human subjects conducted with a lifting device and fabric as described above showed a noticeable beneficial reduction in pressure ulcers in patients, as compared to patients maintained on the bed sheets and lifted with the lifting devices previously used in that hospital.

The foregoing is illustrative of the present invention, and is not to be construed as limiting thereof. The invention is defined by the following claims, with equivalents of the claims to be included therein.

That which is claimed is:

1. A bed sheet comprising:

a continuous length of a single ply woven fabric having a top edge portion, a bottom edge portion, a left side edge portion, and a right side edge portion, said bed sheet having a plurality of wide segments and a plurality of narrow segments integrally woven with one another and arranged parallel to and in a repeating alternating pattern with one another;

each of said wide segments and said narrow segments extending from said left side edge portion to said right side edge portion;

said narrow segments woven from (i) at least a first yarn and (ii) a second yarn, said first yarn having a higher breaking strength than said second yarn;

said wide segments woven from at least said second yarn, and not woven from said first yarn; and a plurality of flexible lifting/securement straps, wherein each of the plurality of flexible lifting/securement straps is connected to a respective narrow segment of said plurality of narrow segments at said left side edge portion or said right side edge portion.

2. The bed sheet of claim 1, wherein said single ply woven fabric:

(i) has an upper and/or lower surface for contacting a person, said upper and/or lower surface having a coefficient of friction not more than 0.4, 0.35, or 0.3;

(ii) after being saturated with water, dries to at least 90 percent dryness within 45 minutes, at room temperature and 70% relative humidity;

(iii) has a tensile strength in pounds per inch of at least 160, 200, or 220 pounds per inch; and (iv) has a tear strength of at least 30, 35, or 40 pounds per inch.

3. The bed sheet of claim 1, wherein said single ply woven fabric is woven in a plain weave, satin weave, or twill weave pattern.

4. The bed sheet of claim 1, wherein said single ply woven fabric comprises:

(i) from 50, 60, 70, 80, 90, 92, or 94 percent by weight to 98, 99 or 100 percent by weight of said first yarn; and from 0, 1 or 2 percent by weight to 6, 8, 10, 20, 30, 40, or 50 percent by weight of said second yarn; or (ii) from 50, 60, 70, 80, 90, 92, or 94 percent by weight to 98 or 99 percent by weight of said second yarn; and from 1 or 2 percent by weight to 6, 8, 10, 20, 30, 40, or 50 percent by weight of said first yarn.

5. The bed sheet of claim 1, wherein said bed sheet is dimensioned for placement over a mattress with said top edge portion positioned below a head portion of the mattress and said bottom edge portion positioned beneath a foot portion of the mattress.

6. The bed sheet of claim 1, wherein said single ply woven fabric is:

from four or five feet wide to seven or eight feet wide from said left side edge portion to said right side edge portion, and/or from six or seven feet long to eleven or twelve feet long from said top edge portion to said bottom edge portion.

7. The bed sheet of claim 1, wherein said second yarn comprises polyester fibers, nylon fibers, or blends of polyester and nylon fibers.

8. The bed sheet of claim 1, wherein said second yarn comprises polyethylene terephthalate fibers, nylon 66 fibers, nylon 6 fibers, or blends of polyethylene terephthalate fibers and the foregoing nylon fibers.

9. The bed sheet of claim 1, wherein said second yarn consists of at least 90 percent by weight of: polyester fibers, nylon 66 fibers, nylon 6 fibers, or blends of the foregoing polyester fibers and nylon fibers.

10. The bed sheet of claim 1, wherein said second yarn:

has a denier of from 150 or 200 to 250 or 300; and/or comprises from 20 or 30 to 40, 50 or 60 fiber filaments per yarn; and/or has a breaking load of from 1,000 to 2,000 grams per yarn; and/or has a percent elongation at break of from 10 or 20 to 40 or 50 percent; and/or has a tenacity of at least 6 or 7 grams per denier; and/or has a tensile strength of from 150 or 200 to 300 or 400 pounds per inch; and/or has a percent elongation of less than 10, 15 or 20 percent after 100 hours at room temperature at thirty percent of its breaking load.

11. The bed sheet of claim 1, further comprising a central region, wherein said plurality of flexible lifting/securement straps surround said central region, and wherein said central region is free of underlying supports and said central region consists of a single layer of said single ply woven fabric.

12. The bed sheet of claim 1, wherein said first yarn comprises liquid crystalline polymer fibers.

13. The bed sheet of claim 1, wherein said first yarn comprises aromatic polyester fibers, poly(p-phenylene-2,6-benzobisoxazole) fibers, aramid fibers, polyether ether ketone (PEEK) fibers, polyetherimide fibers, ultra-high molecular weight polyethylene fibers, poly(p-phenylene-2,6-benzobisoxazole) fibers, polyarylate fibers, high-performance polyethylene fibers, and/or polyphenylene sulfide (PPS) fibers.

14. The bed sheet of claim 1, wherein said first yarn comprises thermoset liquid crystalline fibers.

15. The bed sheet of claim 1, wherein said first yarn comprises ultra-high molecular weight polyethylene fibers.

16. The bed sheet of claim 1, wherein said first yarn comprises repeating units of Formula I and Formula II:

(I)

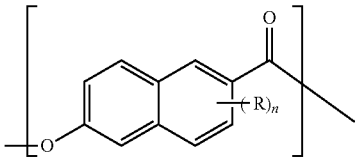

(II)

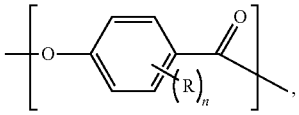

wherein n is 1, 2 or 3, and each R is independently H, C1-C4 alkyl, C1-C4 alkoxy, or halo;

such as fibers consisting essentially of repeating units of Formula Ia and Formula IIa:

(Ia)

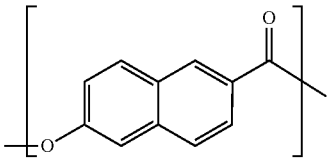

-continued (IIa)

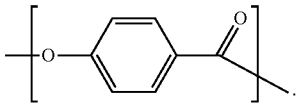

17. The bed sheet of claim 1, wherein said first yarn:
has a denier of from 150 or 200 to 250 or 300; and/or
comprises from 20 or 30 to 50, 60, 100, 170 or 200 fiber filaments per yarn; and/or
has a breaking load of from 3,000 or 4,000 grams per yarn to 6,000 or 11,000 grams per yarn; and/or
has a percent elongation at break of from 1 or 2 percent to 3, 4, 5, 6 or 8 percent; and/or
has a tenacity of 10 or 15 to 30, 40, 50 or 60 grams per denier; and/or
has a tensile strength of from 250 or 300 to 400, 500, 600, 1,200, or 1,400 pounds per inch; and/or
has a percent elongation of less than 0.03, 1, 2, or 4 percent after 100 hours at room temperature at thirty percent of its breaking load.

18. The bed sheet of claim 1, wherein the denier of said first yarn is not more than 10, 20 or 30 percent different than the denier of said second yarn.

19. The bed sheet of claim 1, further comprising an antimicrobial substance that has been topically applied to and/or that is inherently available in the single ply woven fabric.

20. The bed sheet of claim 1, further comprising a unique identifier tag connected to said bed sheet.

21. A bed sheet comprising:
a continuous length of a single ply woven fabric having a top edge portion, a bottom edge portion, a left side edge portion, and a right side edge portion,
said bed sheet having a plurality of wide segments and a plurality of narrow segments integrally woven with one another and arranged parallel to and in a repeating alternating pattern with one another;
each of said wide segments and said narrow segments extending from said left side edge portion to said right side edge portion;
said narrow segments woven from (i) at least a first yarn and (ii) a second yarn, said first yarn having a higher breaking strength than said second yarn;
said wide segments woven from at least said second yarn, and not woven from said first yarn; and
a reinforcing segment under said left side edge portion and/or said right side edge portion of the said single ply woven fabric,
wherein said single ply woven fabric comprises a central region surrounded by the top edge portion, the bottom edge portion, the left side edge portion, and the right side edge portion, and the central region is free of the reinforcing segment.

22. The bed sheet of claim 21, wherein said single ply woven fabric:
(i) has an upper and/or lower surface for contacting a person, said upper and/or lower surface having a coefficient of friction not more than 0.4, 0.35, or 0.3;
(ii) after being saturated with water, dries to at least 90 percent dryness within 45 minutes, at room temperature and 70% relative humidity;
(iii) has a tensile strength in pounds per inch of at least 160, 200, or 220 pounds per inch; and
(iv) has a tear strength of at least 30, 35, or 40 pounds per inch.

23. The bed sheet of claim 21, wherein said second yarn consists of at least 90 percent by weight of: polyester fibers, nylon 66 fibers, nylon 6 fibers, or blends of the foregoing polyester fibers and nylon fibers.

24. The bed sheet of claim 21, wherein said second yarn:
has a denier of from 150 or 200 to 250 or 300; and/or
comprises from 20 or 30 to 40, 50 or 60 fiber filaments per yarn; and/or
has a breaking load of from 1,000 to 2,000 grams per yarn; and/or
has a percent elongation at break of from 10 or 20 to 40 or 50 percent; and/or
has a tenacity of at least 6 or 7 grams per denier; and/or
has a tensile strength of from 150 or 200 to 300 or 400 pounds per inch; and/or
has a percent elongation of less than 10, 15 or 20 percent after 100 hours at room temperature at thirty percent of its breaking load.

25. The bed sheet of claim 21, wherein said first yarn:
has a denier of from 150 or 200 to 250 or 300; and/or
comprises from 20 or 30 to 50, 60, 100, 170 or 200 fiber filaments per yarn; and/or
has a breaking load of from 3,000 or 4,000 grams per yarn to 6,000 or 11,000 grams per yarn; and/or
has a percent elongation at break of from 1 or 2 percent to 3, 4, 5, 6 or 8 percent; and/or
has a tenacity of 10 or 15 to 30, 40, 50 or 60 grams per denier; and/or
has a tensile strength of from 250 or 300 to 400, 500, 600, 1,200, or 1,400 pounds per inch; and/or
has a percent elongation of less than 0.03, 1, 2, or 4 percent after 100 hours at room temperature at thirty percent of its breaking load.

26. The bed sheet of claim 21, wherein the denier of said first yarn is not more than 10, 20 or 30 percent different than the denier of said second yarn.

* * * * *